US008056539B2

(12) United States Patent
Yokura et al.

(10) Patent No.: US 8,056,539 B2
(45) Date of Patent: Nov. 15, 2011

(54) VEHICULAR FUEL SUPPLY EQUIPMENT

(75) Inventors: Yasufumi Yokura, Saitama (JP); Tsuyoshi Izaki, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 383 days.

(21) Appl. No.: 12/359,512

(22) Filed: Jan. 26, 2009

(65) Prior Publication Data

US 2009/0217911 A1 Sep. 3, 2009

(30) Foreign Application Priority Data

Feb. 28, 2008 (JP) ..... 2008-047941
Feb. 28, 2008 (JP) ..... 2008-047967

(51) Int. Cl.
*F02M 37/04* (2006.01)
*F02M 37/00* (2006.01)

(52) U.S. Cl. ..... 123/514; 123/459

(58) Field of Classification Search ..... 123/457, 123/459, 509, 515, 445; 137/565.01, 115.13, 137/547; 210/130, 137
See application file for complete search history.

(56) References Cited

U.S. PATENT DOCUMENTS 4,617,116 A * 10/1986 Seiler ..... 210/137
5,078,167 A * 1/1992 Brandt et al. ..... 137/549
5,433,241 A * 7/1995 Robinson ..... 137/115.13
5,533,478 A * 7/1996 Robinson ..... 123/510
5,584,318 A * 12/1996 Brandt ..... 137/549
5,649,514 A * 7/1997 Okada et al. ..... 123/514
5,830,348 A * 11/1998 Vannoy et al. ..... 210/109
6,065,452 A * 5/2000 Yoshioka ..... 123/509

FOREIGN PATENT DOCUMENTS

JP 62-162375 U 10/1987

* cited by examiner

*Primary Examiner* — Mahmoud Gimie
(74) *Attorney, Agent, or Firm* — Birch, Stewart, Kolasch & Birch, LLP

(57) ABSTRACT

Fuel supply equipment for a vehicle includes a fuel filter cover for covering a fuel filter that is disposed outside of a fuel tank. A fuel pressure regulator for keeping fuel supplied to a fuel injection system under predetermined pressure is arranged so that the fuel pressure regulator is located inside the fuel filter cover and is overlapped with the fuel filter cover when a vehicle is viewed from the side. The fuel pressure regulator is connected to an outflow side of the fuel filter via a fuel hose for keeping fuel supplied to a fuel injection system under predetermined pressure. A holder for supporting the fuel pressure regulator is attached to the fuel filter cover before it is attached to a body frame. The resulting configuration enhances the ability to install and maintain a fuel filter provided outside the fuel tank.

19 Claims, 16 Drawing Sheets

FIG. 19(a)
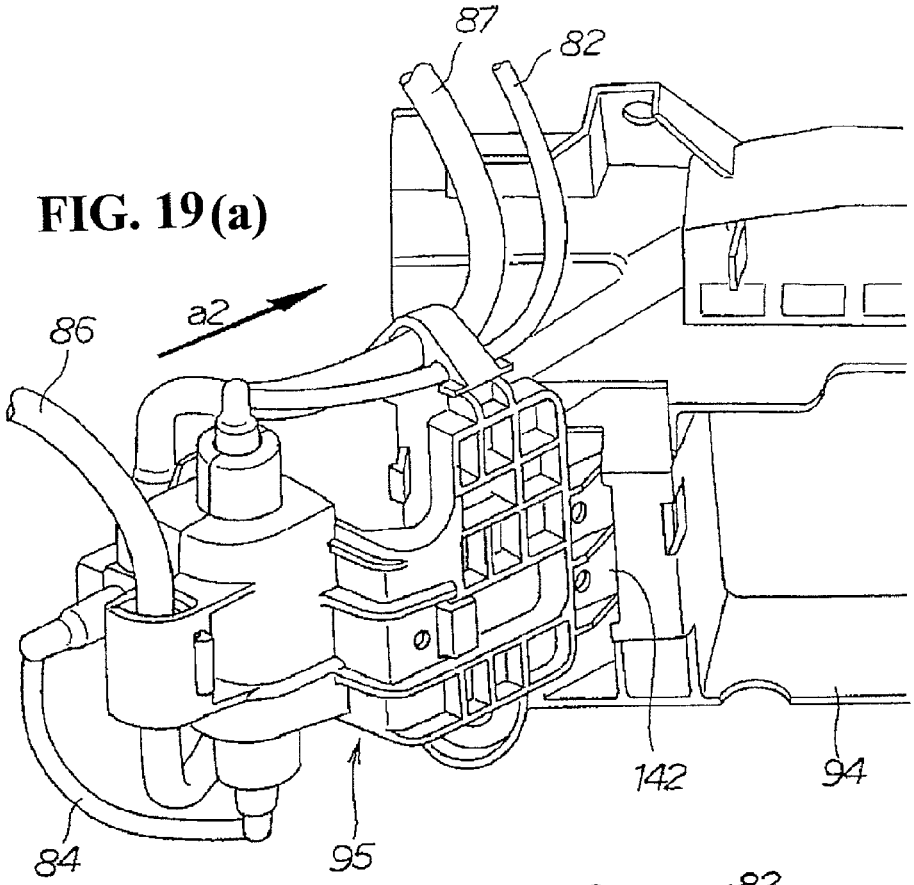
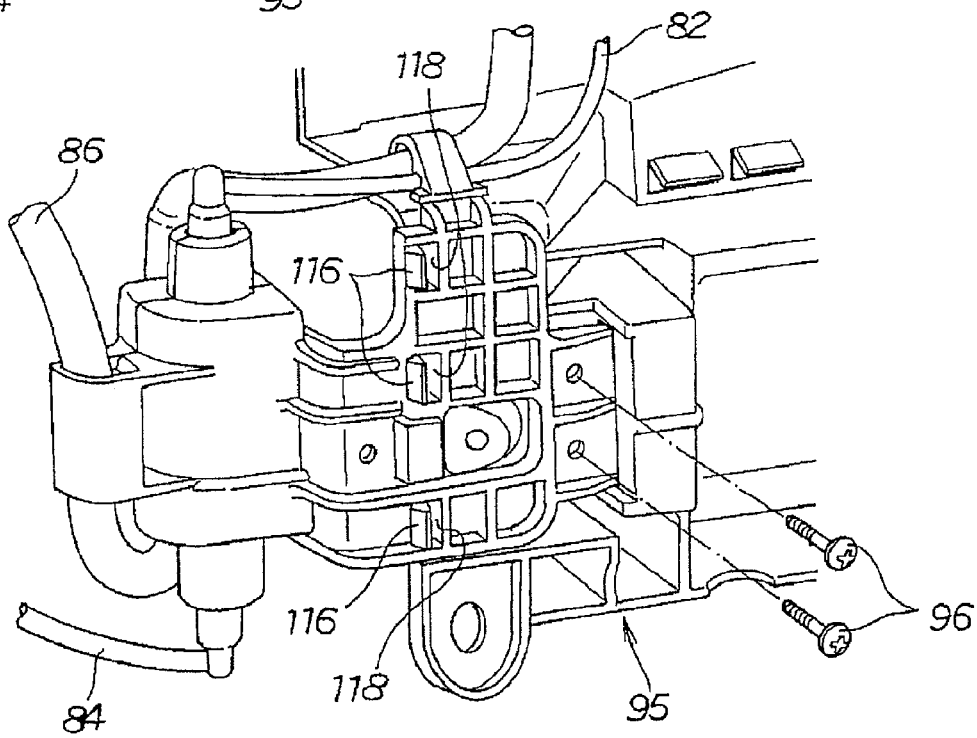
FIG. 19 (b)

VEHICULAR FUEL SUPPLY EQUIPMENT

CROSS-REFERENCE TO RELATED APPLICATION

The present application claims priority under 35 U.S.C. §119 to Japanese Patent Application Nos. 2008-047967 and 2008-047941, both filed Feb. 28, 2008, the entire contents of which are hereby incorporated by reference.

BACKGROUND OF THE INVENTION

1. Field of the Invention

The present invention relates to vehicular fuel supply equipment and an installation structure for a fuel filter of a vehicle provided with a fuel pressure regulator.

2. Description of Background Art

Vehicular fuel supply equipment provided with a fuel pressure regulator for keeping fuel supplied to an internal combustion engine under predetermined pressure is known (for example, refer to JP-U No. S62-162375 (FIG. 1).

As shown in FIG. 1 of JP-U No. S62-162375, vehicular fuel supply equipment is provided with a fuel tank 1 (also hereinafter, reference numerals in the patent document 1 will be used as they are), a fuel pump 6 connected to the fuel tank 1 via a fuel pipe 5A, a regulator 7 connected to the outflow side of the fuel pump 6, an injector 8 connected to the regulator 7 via a fuel pipe 5B and a return pipe 9 for returning extra fuel from the regulator 7 to the fuel tank 1.

There is a case that a fuel filter is inserted in an intermediate part of the fuel pipe 5A for example in the fuel supply equipment in JP-U No. S62-162375. The fuel filter is different from the existing fuel filter provided to the fuel tank 1.

A hose on the outflow side of the fuel pump 6, the fuel pipe 5B and the return hose 9 are connected to the fuel pressure regulator 7 and many pipes are already connected, if a new fuel filter is added, the number of pipes connected to the fuel filter further increases. When the number of pipes is increased, a problem that assembly work gets intricate occurs.

In the fuel supply equipment, when the fuel filter and the fuel pressure regulator to which the three hoses are connected are added outside the fuel tank, it is desirable that technique for enabling enhancing productivity related to assembly is provided.

The fuel pipes 5A and 5B and the return pipe 9 are connected to the regulator 7 and are connected to the fuel filter provided on the upstream side of the regulator 7.

In such a case, depending upon positional relation between the regulator 7 and the fuel filter, it may be difficult to identify which pipe should be detached and it is important to prevent maintainability from being deteriorated.

SUMMARY AND OBJECTS OF THE INVENTION

An object of the invention is to provide technique for enabling enhancing productivity related to assembly in installation structure of a vehicular fuel filter when a fuel filter is provided outside a fuel tank. Another object of the invention is to provide technique for enabling enhancing the maintainability of a fuel filter in vehicular fuel supply equipment provided.

According to an embodiment of the present invention, vehicular fuel supply equipment includes a fuel tank that stores fuel for an internal combustion engine, a fuel pump that feeds the fuel in the fuel tank to a fuel injection system provided to the internal combustion engine. In addition, a fuel filter is connected to the outflow side of the fuel pump and provided outside the fuel tank for filtering the fuel, a fuel hose is connected to the outflow side of the fuel filter, and a fuel pressure regulator is connected to the fuel hose for keeping the fuel supplied to the fuel injection system under predetermined pressure.

Further, a joining pipe is connected between the fuel pressure regulator and the fuel injection system and a return hose connected between the fuel pressure regulator and the fuel tank for returning extra fuel to the fuel tank, a fuel filter cover that covers the fuel filter is provided around the fuel filter and the fuel pressure regulator is arranged so that the fuel pressure regulator is located inside the fuel filter cover and is overlapped with the fuel filter cover when a vehicle is viewed from the side.

According to an embodiment of the present invention, a covering part including a hinged part for holding the fuel filter is provided to the fuel filter cover.

According to an embodiment of the present invention, each connector is connected to both ends of the fuel filter and each connector is covered with the fuel filter cover.

According to an embodiment of the present invention, an installation structure of a fuel filter of a vehicle includes a filter cover that encircles the fuel filter and a holder that is attached to the filter cover before the filter cover is attached to the body frame and supports the fuel pressure regulator.

According to an embodiment of the prevent invention, a direction of a longitudinal shaft of the fuel pressure regulator is arranged in a vertical direction of the vehicle, the fuel hose is connected to the side of the longitudinal shaft, and the joining pipe and the return hose are connected in an axial direction of the longitudinal shaft. In addition, an opening on the side of the holder wider than an outside diameter of the fuel pressure regulator in the direction of the longitudinal shaft provided to the fuel pressure regulator is provided to the side on the filter cover side of the holder, and a cutout communicating with the opening on the side of the holder and wider than an outside diameter of the fuel hose is provided to the holder. Further, a first shaft releasing part wider than an outside diameter of the return hose and a second shaft releasing part wider than an outside diameter of the joining pipe are provided on an axis of the longitudinal shaft in a state in which the fuel pressure regulator is held in the holder.

According to an embodiment of the present invention, a rib for pressing the fuel pressure regulator is planted on the filter cover along the side of the fuel pressure regulator opposite to the first and second shaft releasing parts.

According to an embodiment of the present invention, a pair of opposite pawl bars are provided to the filter cover, a holder bolster for receiving the holder is provided to lower ends of these pawl bars, a sliding part is provided to the holder and the holder is attached to the filter cover by sliding the sliding part on the pawl bars.

According to an embodiment of the present invention, a hinge arm including a hinged part for holding the fuel hose is provided to the filter cover.

According to an embodiment of the present invention, a convex portion is provided to the filter cover along the periphery of the fuel filter.

Effects of the present invention include the following:

According to an embodiment of the present invention, the fuel filter cover that covers the fuel filter is provided around the fuel filter and the fuel pressure regulator is arranged so that the fuel pressure regulator is located inside the fuel filter cover and is overlapped with the fuel filter cover in a side view.

A workman can easily recognize the fuel filter to be maintained by almost hiding the fuel pressure regulator from the side with the fuel filter cover. In addition, as the fuel pressure regulator is arranged so that it is located inside the fuel filter cover and is overlapped with the fuel filter cover when the vehicle is viewed from the side, the plural pipes and hoses such as the fuel hose connected to the fuel pressure regulator and the fuel filter can be easily discriminated. As the mutually close plural pipes and hoses are easily discriminated, wrong work in the connection of the pipes and hoses can be avoided.

As the fuel filter can be easily recognized and in addition, the pipe and hose connected to the fuel filter can be easily discriminated, the maintainability of the fuel filter can be enhanced.

According to an embodiment of the present invention, as the covering part that includes the hinged part and holds the fuel filter is provided to the fuel filter cover, the covering part can be opened/closed with the fuel filter cover attached on the side of the vehicle. As the covering part is openably configured, the fuel filter can be more easily maintained.

According to an embodiment of the present invention, as the connector is covered with the fuel filter cover, dust and others can be almost prevented from adhering to the connection of the connector. Dust and others hardly adhere to the connection of the connector and the connection of the connector can be easily kept clean. As the connection of the connector can be easily kept clean, maintenance can be more easily made without almost caring the contamination of the connection.

According to an embodiment of the present invention, the fuel supply equipment is provided with the fuel filter, the filter cover encircling the fuel filter, the holder attached to the filter cover and the fuel pressure regulator supported by the holder. The fuel pressure regulator and the holder are attached to the filter cover beforehand.

The filter cover with which the fuel pressure regulator is integrated beforehand is prepared. When the fuel filter is provided on the side of the body frame in assembling the vehicle, the filter cover and the fuel pressure regulator can be simultaneously attached to the vehicle by attaching the filter cover with the fuel pressure regulator integrated to the fuel filter.

As the fuel pressure regulator is attached to the filter cover via the holder beforehand, assembly work can be easily performed when the filter cover is attached to the vehicle. As the assembly work is easily performed, a load related to the work can be reduced and work time related to the assembly of the fuel supply equipment can be reduced. As the work time related to the assembly can be reduced, productivity related to the assembly can be enhanced.

As the fuel pressure regulator is attached to the filter cover beforehand, the possibility of wrong assembly such as mistake in the attachment of a pipe can be reduced, compared with a case that the fuel pressure regulator is not attached to the filter cover beforehand.

According to an embodiment of the present invention, the cutout is provided to the holder, and the first shaft releasing part and the second shaft releasing part are provided on the axis of the longitudinal shaft provided to the fuel pressure regulator.

When the fuel pressure regulator is set in the holder, the side of the filter cover of the holder is bored, the first and second shaft releasing parts which the joining pipe and the return hose respectively connected in the axial direction of the longitudinal shaft pierce are provided, and the cutout which the fuel hose connected to the side of the longitudinal shaft pierces is provided.

In this case, as the joining pipe pierces the first shaft releasing part, the return hose pierces the second shaft releasing part and the fuel hose can pierce the cutout, the fuel pressure regulator can be easily set in the holder. Therefore, ease of setting the fuel pressure regulator can be enhanced.

According to an embodiment of the present invention, the rib for pressing the fuel pressure regulator along the side of the fuel pressure regulator opposite to the first and second shaft releasing parts is planted on the filter cover.

When the fuel pressure regulator is attached to the filter cover, the fuel pressure regulator is pressed by the holder in which the fuel pressure regulator is set and the rib planted on the filter cover. As the rib is provided to the filter cover, the fuel pressure regulator can be almost prevented from being arranged off a predetermined housed position. Therefore, the fuel pressure regulator can be securely held between the filter cover and the holder without increasing the number of parts.

According to an embodiment of the present invention, when the holder that supports the fuel pressure regulator is attached to the filter cover beforehand before the filter cover is attached to the body frame, the holder can be attached to the filter cover without using a fastening member such as a screw. As no fastening member is required, the number of parts can be reduced. In addition, as attachment work is facilitated, ease of attaching the holder to the filter cover can be enhanced.

According to an embodiment of the present invention, as the hinge arm including the hinged part for holding the fuel hose is provided to the filter cover, no guide for the fuel hose is required to be separately provided. As a guide for the fuel hose is not required separately, the number of parts can be reduced.

According to an embodiment of the present invention, as the convex portion is provided to the filter cover along the periphery of the fuel filter, there is no fear that the fuel filter rattles in a state in which the fuel filter is built in the filter cover. As there is no fear that the fuel filter rattles, the fuel filter can be securely held in the filter cover without increasing the number of parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 19(*a*) and (*b*) are explanatory drawings for explaining action according to the invention (the attachment of the filter cover to a battery box)

DETAILED DESCRIPTION OF THE PREFERRED EMBODIMENTS

Figure 1:
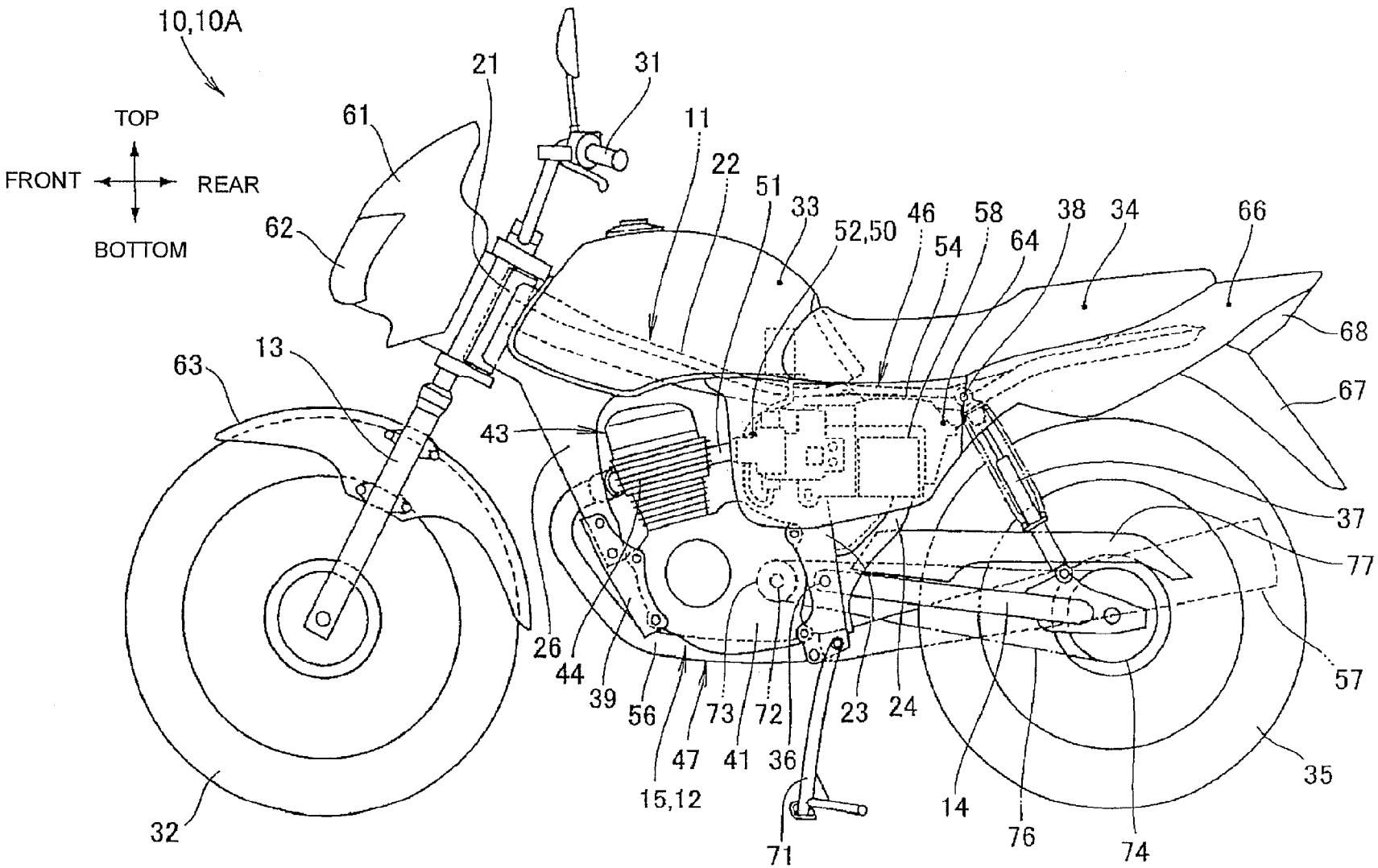
FIG. 1 is a left side view showing a vehicle provided with a multi-fuel internal combustion engine according to the invention.

In the drawings and an embodiment, the "upside", the "downside", the "front", the "rear", the "right" and the "left" denote locations viewed from a rider seated on a motorcycle. The drawings shall be viewed in a direction of reference numerals.

FIG. 1 is a left side view showing a vehicle provided with a multi-fuel internal combustion engine according to the invention, the vehicle 10 is a motorcycle 10A where the engine 12 as the internal combustion engine 15 is arranged in the center of a body frame 11, a front fork 13 is steerably supported by a front end of the body frame 11 and a rear fork 14 is vertically swingably supported by a lower part of the rear of the body frame 11, for main fuel, ethanol, gasoline or the mixture of gasoline and ethanol are used, and in starting the engine, gasoline or the mixture (however, the mixture ratio of gasoline is larger than the mixture ratio of the main fuel) of gasoline and ethanol is used for vice-fuel only when air temperature is low and the startability of the engine is not good for example.

The body frame 11 includes a head pipe 21 provided to the front end, a main frame 22 extended backward from the head pipe 21, a center frame 23 extended downward from an intermediate part of the main frame 22, a subframe 24 coupled to the rear of the main frame 22 and a lower part of the center frame 23 and a down frame 26 extended backward and diagonally downward from the head pipe 21, and is a skeletal member to which plural press moldings are connected.

The head pipe 21 is a part to which the front fork 13 is turnably attached, a handlebar 31 is attached to an upper part of the front fork 13, and a front wheel 32 is attached to its lower part. The main frame 22 is a member to the front of which a fuel tank 33 for storing the main fuel is attached with the fuel tank straddling the main frame and to the rear of which an occupant seat 34 is attached.

The center frame 23 is a part for supporting the engine 12 together with the down frame 26 and a pivot 36 provided to the center frame 23 functions as a swinging shaft of the rear fork 14. A rear wheel 35 is attached to a rear end of the rear fork 14.

A rear cushion unit 37 is installed between the rear of the rear fork 14 and the rear of the main frame 22 and is attached to them. A reference numeral 38 denotes a mounting shaft provided to the main frame 22 for attaching an upper end of the rear cushion unit 37.

The down frame 26 is a part for supporting the engine 12 via a bracket 39.

The engine 12 is suspended from the body frame 11, a transmission 41 is integrated with the rear of the engine, a cylinder head 44 is provided to a cylinder part 43 extended upward, an intake system 46 is connected to the rear of the cylinder head 44, and an exhaust system 47 is connected to the front of the cylinder head 44.

Figure 2:
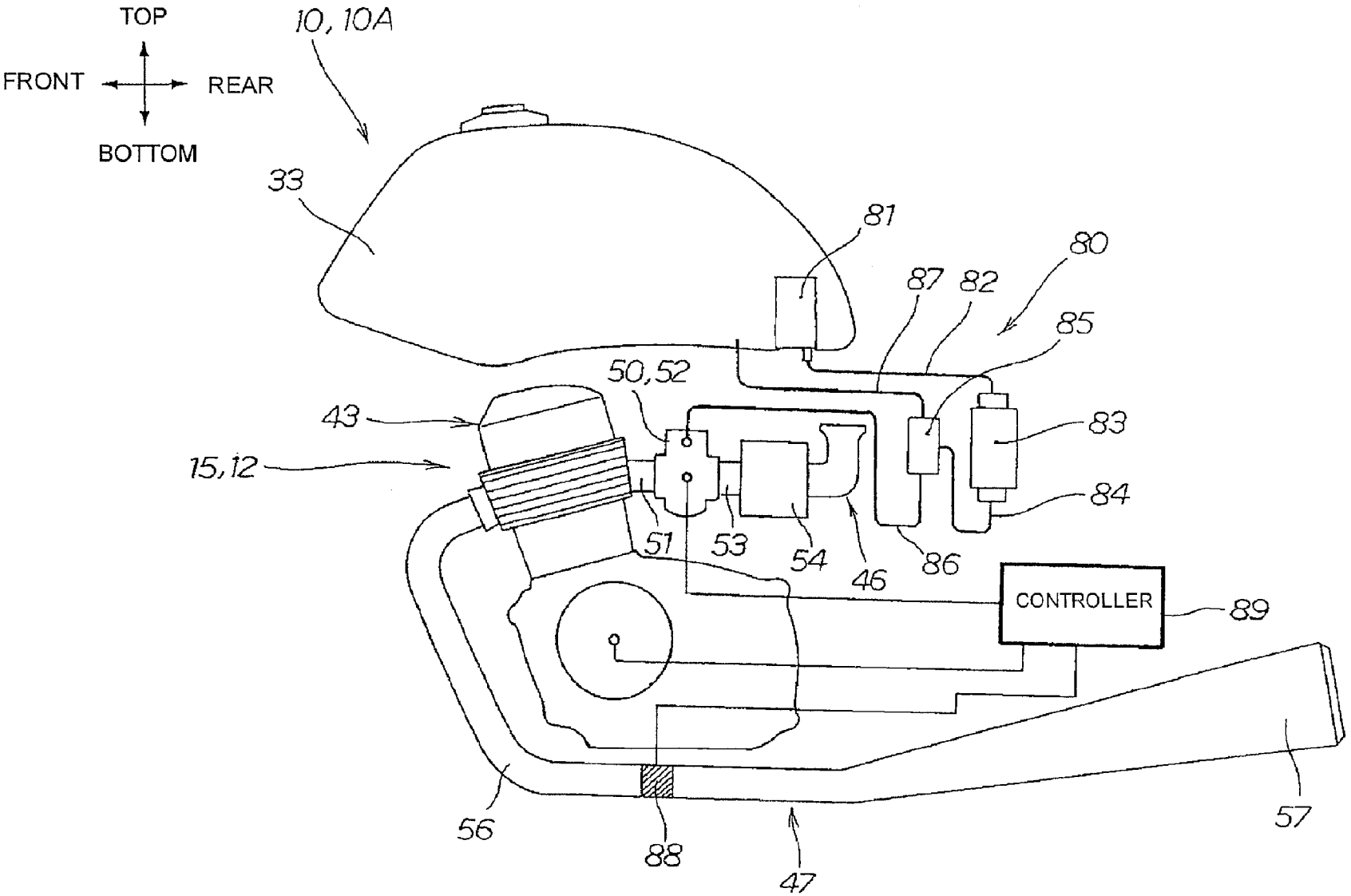
FIG. 2 is a schematic diagram showing the vehicle according to the invention.

The intake system 46 includes an intake pipe 51 one end of which is connected to the cylinder head 44, a throttle body 52 one end of which is connected to the other end of the intake pipe 51 and in which a fuel injection system 50 is built and an air cleaner 54 connected to the other end of the throttle body 52 via a connecting tube (a reference numeral 53 in FIG. 2).

The exhaust system 47 includes an exhaust pipe 56 one end of which is connected to the front of the cylinder head 44 and which is extended downward and backward from the front side of the engine 12 and a muffler 57 connected to the other end of the exhaust pipe 56 and extended backward.

In FIG. 1, a reference numeral 58 denotes a battery, 61 denotes a front cowl, 62 denotes a headlamp, 63 denotes a front fender, 64 denotes a side cover that covers the side of the air cleaner 54, 66 denotes a rear side cover, 67 denotes a rear fender, 68 denotes a tail lamp, 71 denotes a main stand, 72 denotes an output shaft of the transmission 41, 73 denotes a drive sprocket attached to the output shaft 72, 74 denotes a driven sprocket integrated with the rear wheel 35, 76 denotes a chain wound onto the drive sprocket 73 and the driven sprocket 74, and 77 denotes a chain cover.

FIG. 2 is a schematic diagram showing the vehicle according to the invention and explains fuel supply equipment provided to the motorcycle 10A as the vehicle 10 of the engine.

In the motorcycle 10A, the fuel supply equipment 80 that supplies fuel to the engine 12 as the internal combustion engine 15 using multiple types of fuel and the fuel tank 33 that is connected to the fuel supply equipment 80 and stores fuel are provided.

The fuel supply equipment 80 includes the fuel tank 33 provided to the body frame 11, a fuel pump 81 arranged inside the fuel tank 33 for feeding fuel to the fuel injection system 50, and a supply pipe 82 extended from the fuel pump 81, a fuel filter 83 connected to an end of the supply pipe 82 for filtering fuel, a fuel hose 84 extended from the fuel filter 83. A fuel pressure regulator 85 is connected to an end of the fuel hose 84 for keeping fuel under fixed pressure, and a rubber joining pipe 86 extends from one end of the fuel pressure regulator 85 for high-pressure fuel. Also included are a throttle body 52 which is connected to the joining pipe 86 and in which the fuel injection system 50 that injects fuel into air, and a return hose 87 extending from the other end of the fuel pressure regulator 85 and connected to the fuel tank 33 for returning extra fuel to the fuel tank 33. An oxygen sensor 88 is provided inside the exhaust pipe 56 for measuring the quantity of oxygen included in exhaust gas of the engine 12 for controlling air-fuel ratio. A controller 89 is connected to the oxygen sensor 88 for controlling the fuel injection system 50 so that air-fuel mixture supplied to the engine 12 has predetermined air-fuel ratio.

Figure 3:
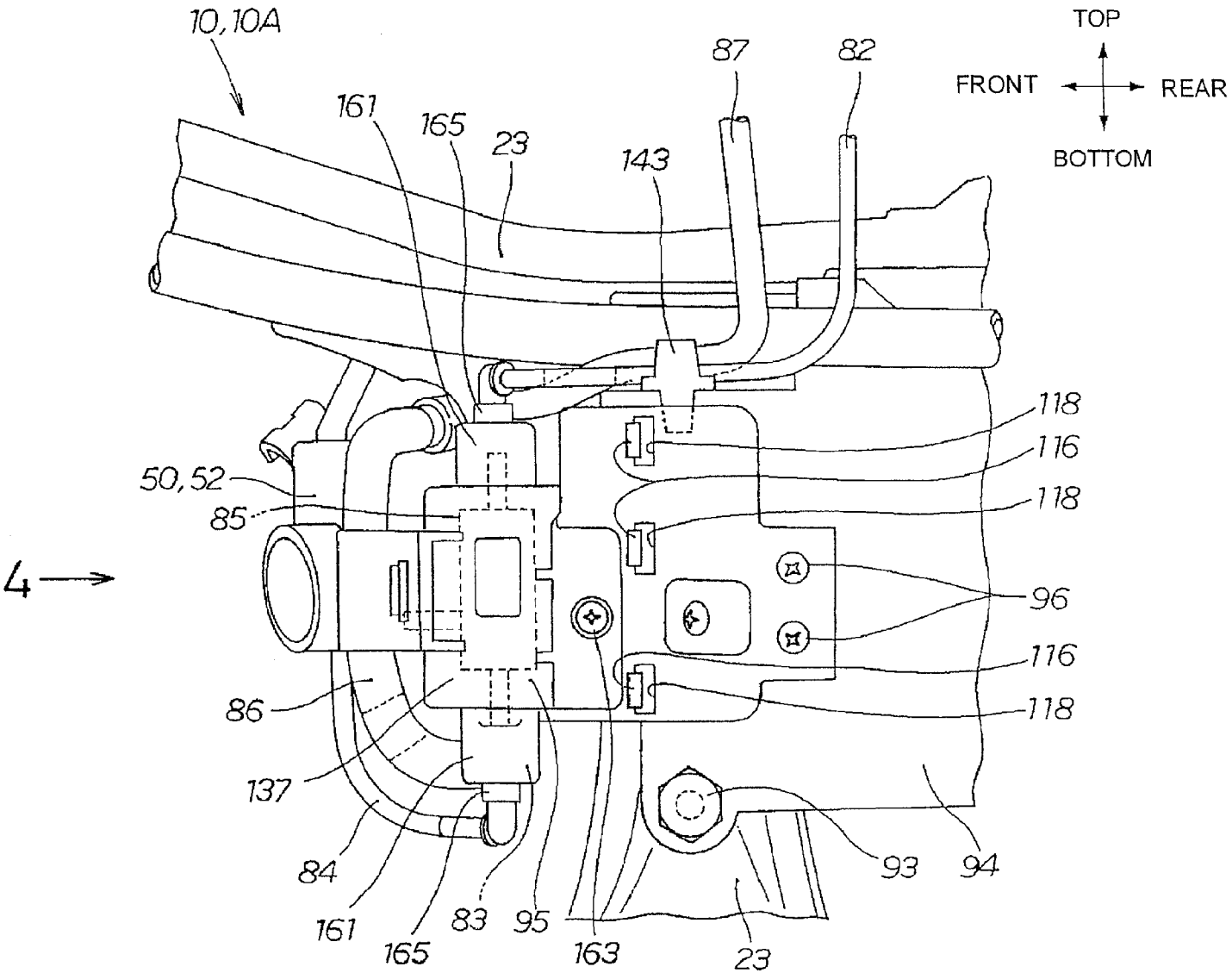
FIG. 3 is a side view showing a main part of the vehicle according to the invention.
Figure 4:
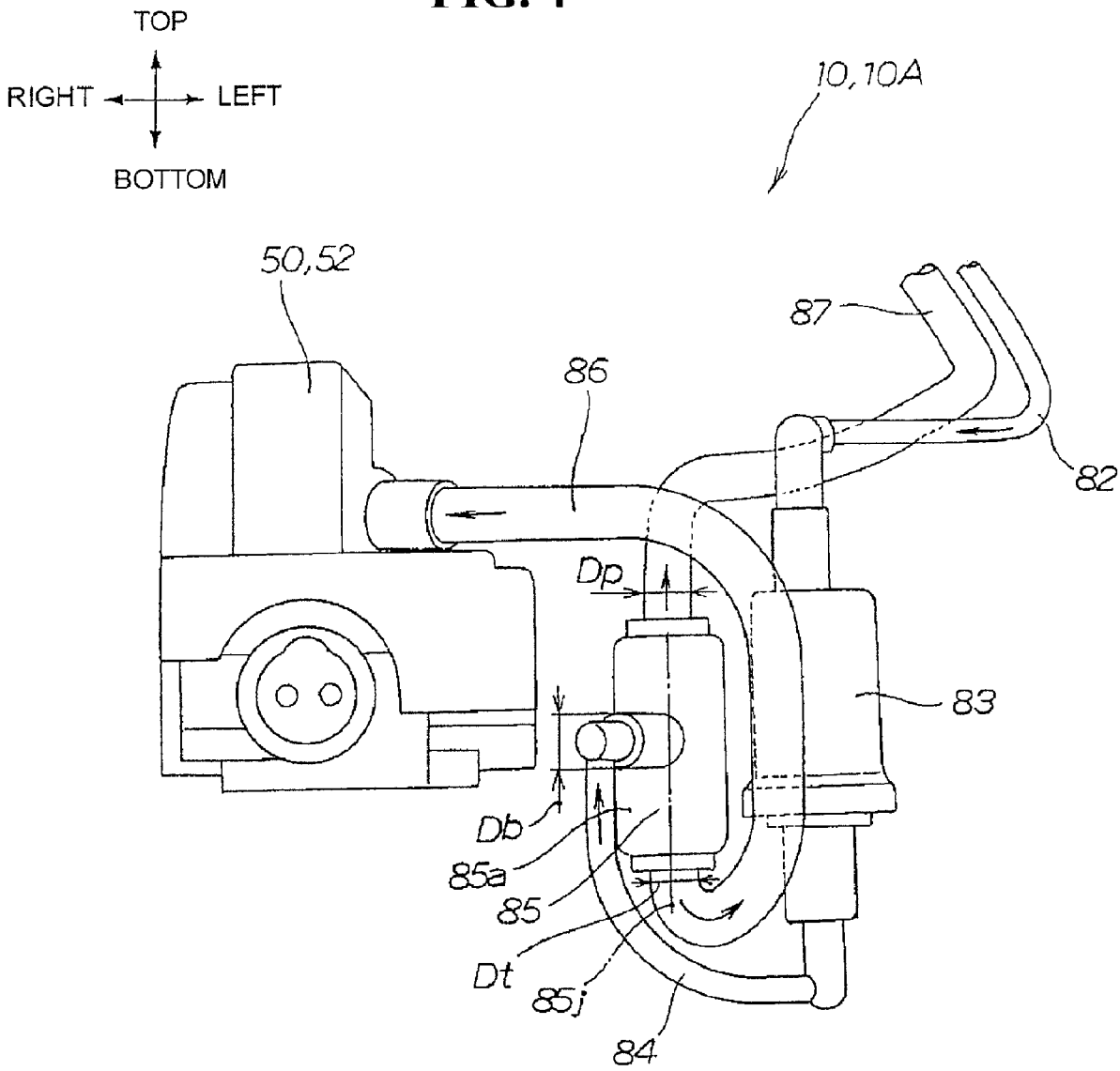
FIG. 4 is a view viewed from a direction shown by an arrow 4 in FIG. 3.

FIG. 3 is a side view showing a main part of the vehicle according to the invention and FIG. 4 is a view viewed from a direction shown by an arrow 4 in FIG. 3. In FIG. 4, to define positional relation among each member, members except the fuel filter 83, the fuel pressure regulator 85, the throttle body 52 and the pipes connected to each member are omitted. Referring to FIGS. 3 and 4, the above-mentioned members will be described below.

A battery box 94 for housing the battery (the reference numeral 58 in FIG. 1) is attached to the side of the center frame 23 arranged in the substantial center in a longitudinal direction of the body frame 11 via a bolt 93, a filter cover 95 is attached to the front of the battery box 94 by screws 96, 96, and the fuel filter 83 is arranged inside the filter cover 95. That is, the filter cover 95 that covers the fuel filter 83 and supports it is provided to the circumference of the fuel filter 83.

The fuel pressure regulator 85 is arranged on the center side in a direction of vehicle width of the fuel filter 83 and the throttle body 52 (including the fuel injection system 50) is arranged on the center side in the direction of vehicle width of the fuel pressure regulator 85. Detailedly, the fuel pressure regulator 85 is arranged inside the filter cover 95 with the fuel pressure regulator overlapped with the filter cover 95 when the motorcycle 10A is viewed from the side.

The fuel pressure regulator 85 is arranged with an axis 85*j* of a longitudinal shaft 85*a* in a vertical direction of the vehicle 10, the fuel hose 84 is connected to the side of the longitudinal shaft 85*a*, and the joining pipe 86 and the return hose 87 are connected to the fuel pressure regulator in the axial direction 85*j* of the longitudinal shaft 85*a*.

Figure 5:
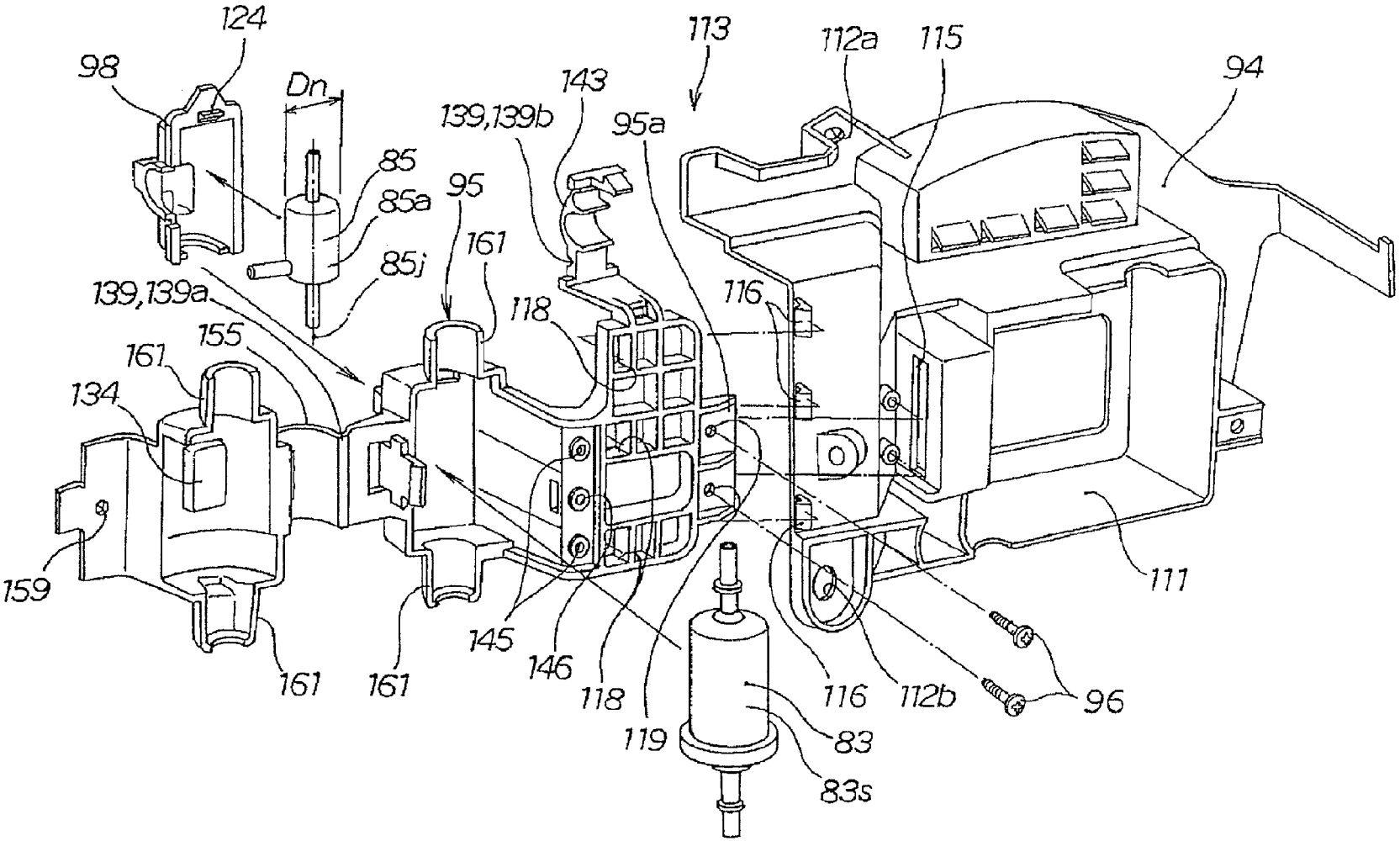
FIG. 5 is an exploded perspective view for explaining structure for supporting a fuel filter and a fuel pressure regulator on the side of a vehicle body in structure for attaching the fuel filter of the vehicle according to the invention.

FIG. 5 is an exploded perspective view for explaining structure for supporting the fuel filter and the fuel pressure regulator on the side of the body in the fuel supply equipment of the vehicle according to the invention, the filter cover 95 for covering and holding the fuel filter 83 is attached to the front of the battery box 94 attached to the body frame (the reference numeral 11 in FIG. 1) via the screws 96, 96, and the fuel pressure regulator 85 is attached to the filter cover 95 via a holder 98.

FIG. 5 illustrates fastening holes 119, 119 for fastening the filter cover 95 to the battery box 94 by the screws 96, 96.

Figure 6:
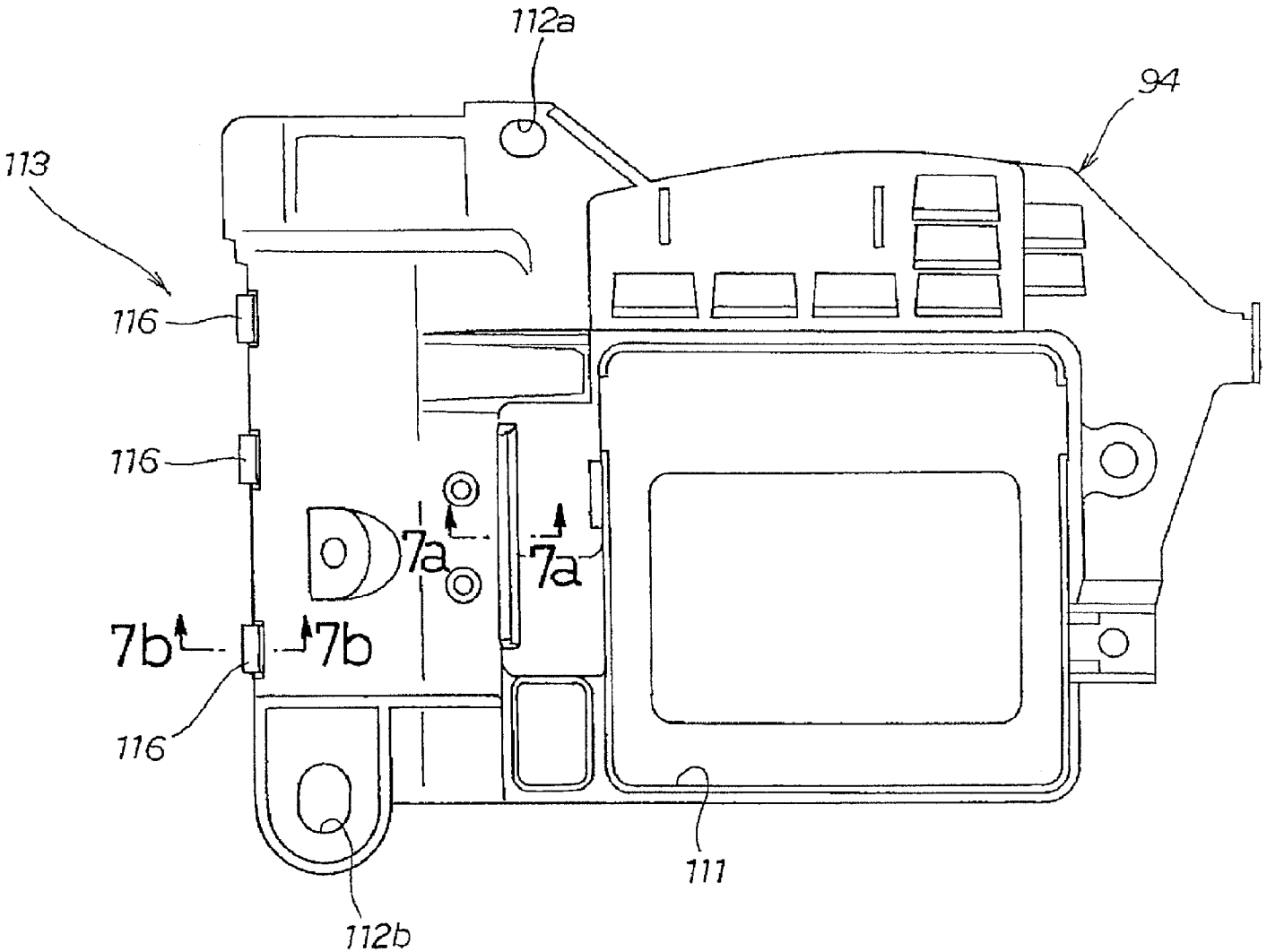
FIG. 6 is a side view showing a battery box according to the invention.
Figure 7A:
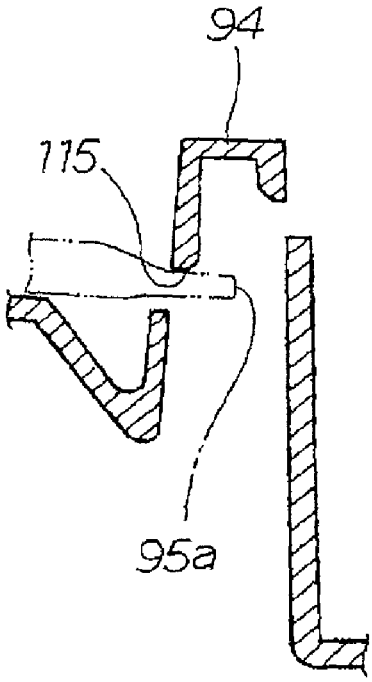
FIGS. 7(*a*) and (*b*) are sectional views viewed along a line 7*a*-7*a* and a line 7*b*-7*b* in FIG. 6.
Figure 7B:
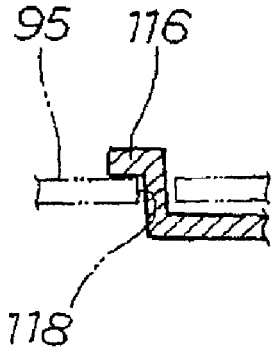

FIG. 6 is a side view showing the battery box according to the invention, FIG. 7(*a*) is a sectional view viewed along a line 7*a*-7*a* in FIG. 6, and FIG. 7(*b*) is a sectional view viewed along a line 7*b*-7*b* in FIG. 6. Referring to FIGS. 5, 6, 7(*a*) and 7(*b*), explanation will be made below.

A battery housing 111, mounting holes 112*a*, 112*b* for mounting the battery box on the body frame (the reference numeral 11 in FIG. 1) and a fitting part 113 for fitting the filter cover 95 to the front are provided to the battery box 94.

The fitting part 113 includes a rectangular hole 115 into which an end 95*a* of the filter cover 95 is inserted so as to align the filter cover 95 with the battery box 94 and pawls 116 for fastening the filter cover 95 to the battery box 94.

A holding hole 118 for fitting to each pawl 116 is bored in the filter cover 95 and each pawl 116 is fixed into each holding hole 118.

Figure 8:
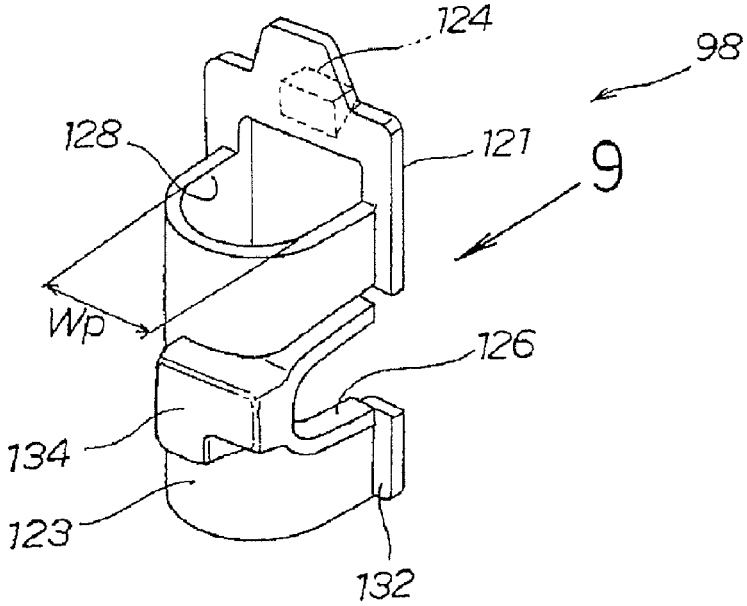
FIG. 8 is a perspective view showing a holder according to the invention.
Figure 9:
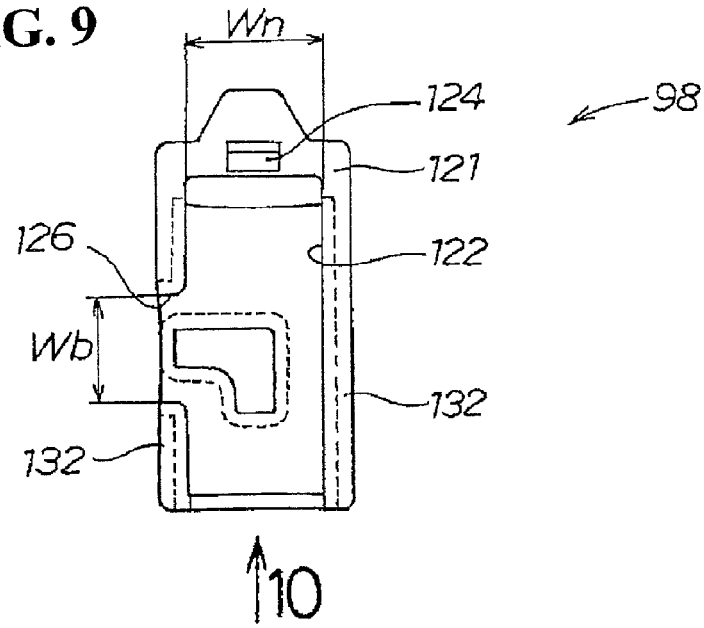
FIG. 9 is a view viewed from a direction shown by an arrow 9 in FIG. 8.
Figure 10:
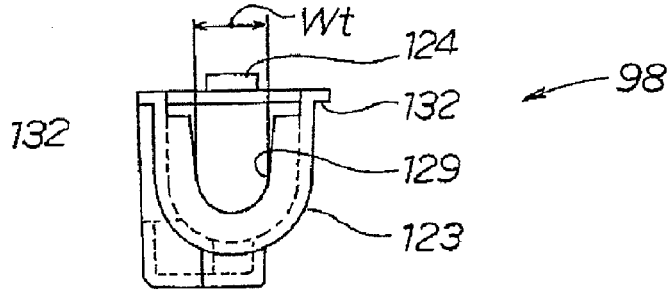
FIG. 10 is a view viewed from a direction shown by an arrow 10 in FIG. 9.

FIG. 8 is a perspective view showing the holder according to the invention, FIG. 9 is a view viewed from a direction shown by an arrow 9 in FIG. 8, and FIG. 10 is a view viewed from a direction shown by an arrow 10 in FIG. 9. Referring to FIGS. 8 to 10, explanation will be made below.

The holder 98 is provided with the side 121 on the side of the filter cover as a part for mounting the holder on the filter cover 95, an opening 122 on the side of the holder provided in a direction of the longitudinal shaft 85*a* provided to the fuel pressure regulator (the reference numeral 85 in FIG. 5) and having width Wn wider than an outside diameter Dn of the fuel pressure regulator 85, a U-shaped holding part 123 extended in a substantial U shape from the side 121 on the side of the filter cover in a bottom view for holding the side of the fuel pressure regulator 85 and a pawl 124 provided to an upper part of the side 121 on the side of the filter cover for fastening the holder 98 to the side of the filter cover 95.

A cutout 126 communicating with the opening 122 on the side of the holder and having width Wb wider than an outside diameter (a reference code Db in FIG. 4) of the fuel hose 84 so that the fuel hose 84 can be inserted is provided to the holder 98, and a first shaft releasing part 128 having width Wp wider than an outside diameter (a reference code Dp in FIG. 4) of the return hose 87 and a second shaft releasing part 129 having width Wt wider than an outside diameter (a reference code Dt in FIG. 4) of the joining pipe 86 are provided on the axis 85*j* of the longitudinal shaft 85*a* forming the fuel pressure regulator 85 in a state in which the fuel pressure regulator (the reference numeral 85 in FIG. 4) is held in the holder 98.

A sliding part 132 slidably held by pawl bars provided to the filter cover 95 is provided to both ends of the side 121 on the side of the filter cover provided to the holder 98. The details of the pawl bars will be described later.

In FIG. 8, a reference numeral 134 denotes a convex portion formed on the U-shaped holding part 123, space inside the holder 98 is increased by providing the convex portion, and as a result, contact between the fuel hose 84 inserted into the cutout 126 and a damper and others provided in a connection of the fuel pressure regulator 85 and a connector is avoided.

Figure 11:
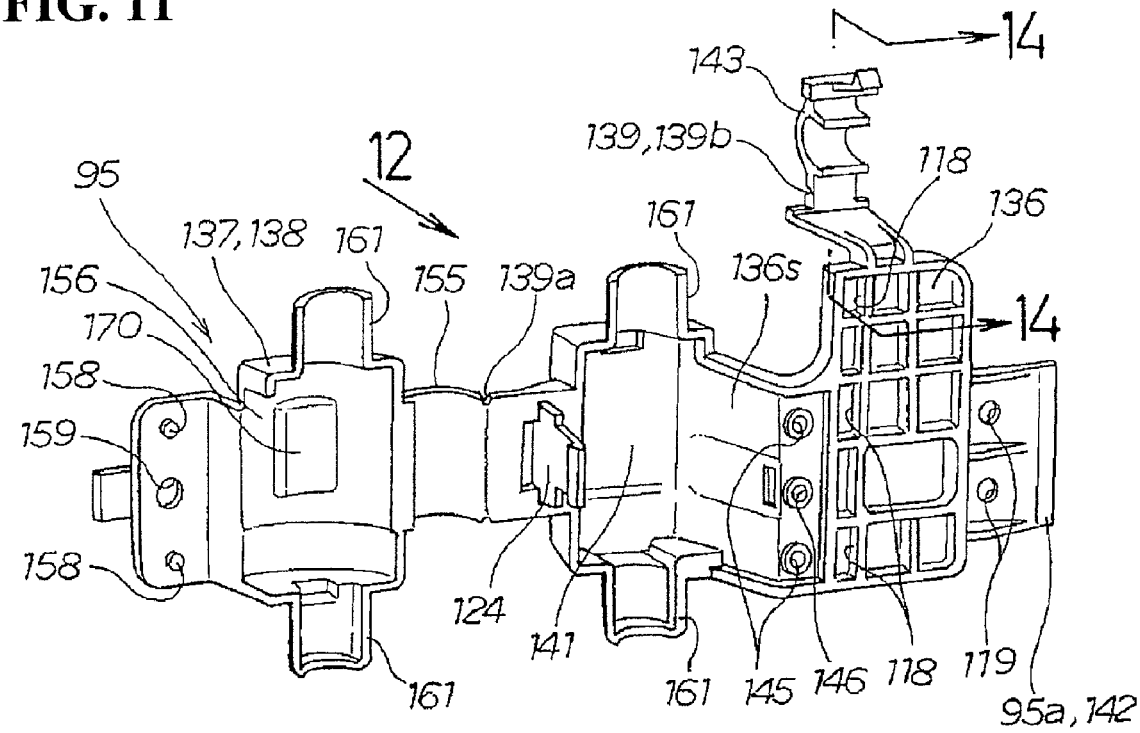
FIG. 11 is a perspective view showing a filter cover according to the invention.
Figure 12:
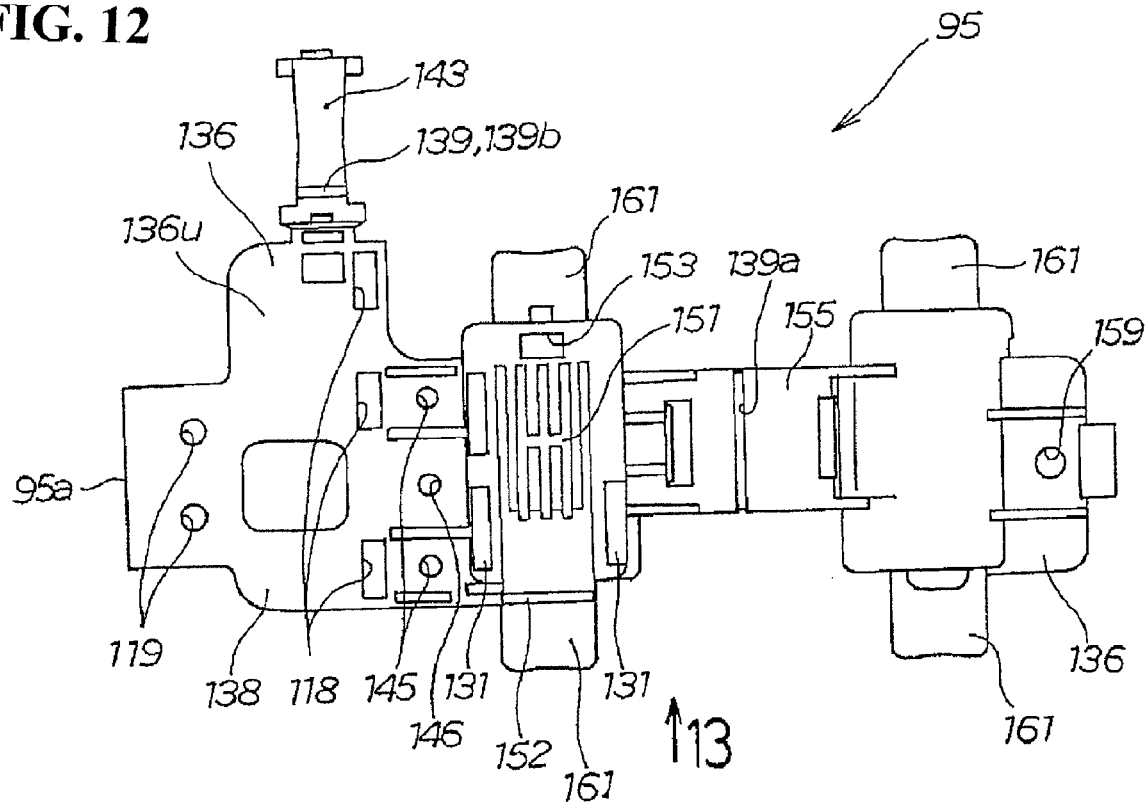
FIG. 12 is a view viewed from a direction shown by an arrow 12 in FIG. 11.
Figure 13A:
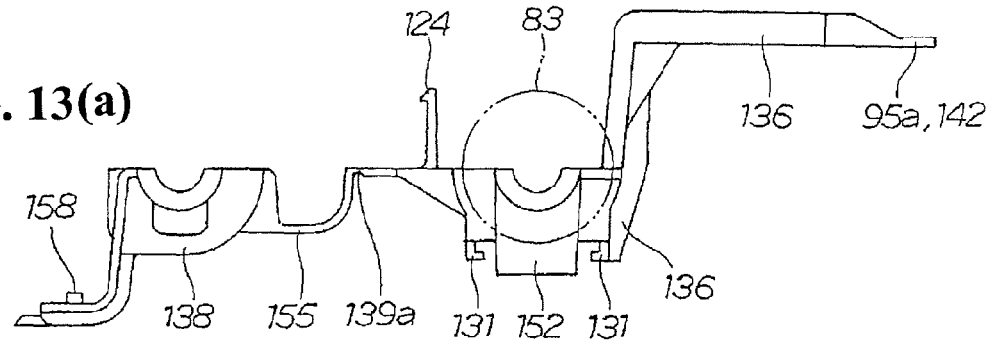
FIGS. 13(*a*) and (*b*) are views viewed from a direction shown by an arrow 13 and its assembly drawing in FIG. 12.
Figure 13B:
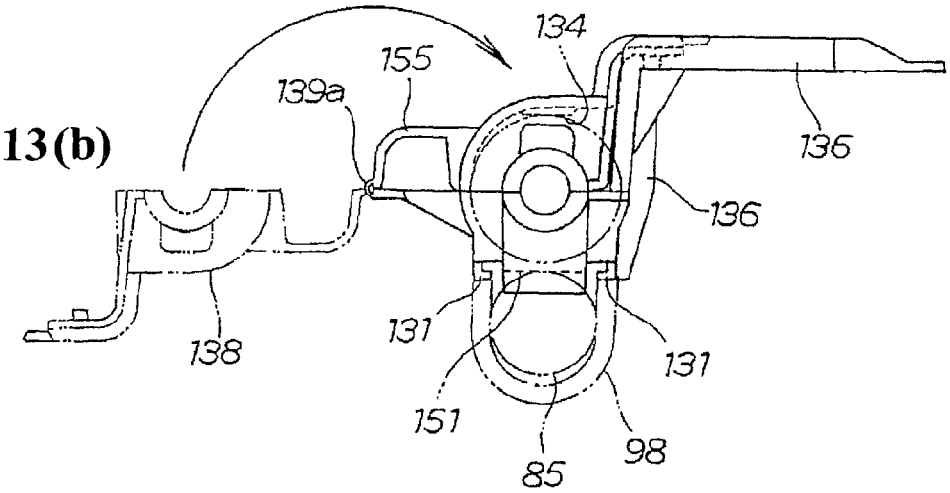

FIG. 11 is a perspective view showing the filter cover according to the invention, FIG. 12 is a view viewed from a direction shown by an arrow 12 in FIG. 11, FIGS. 13(*a*) and (*b*) are views viewed from a direction shown by an arrow 13 in FIG. 12 and its assembly drawing. Also referring to FIG. 5 together with FIGS. 11 to 13(*a*) and (*b*), explanation will be made below.

The filter cover 95 plays a role of holding the fuel filter 83, holding the fuel pressure regulator 85 and fastening the pipes connected to each member. The filter cover 95 is mainly provided with a first half body 136 provided on the side of the body frame 11 as a base attached to the battery box 94 and a second half body 138 combined with the first half body 136 as a covering part 137 that covers the fuel filter 83. The covering part 137 includes a first hinge 139*a* as a hinged part 139.

On the outside surface 136*s* of the first half body 136, a guide pawl 124 that guides the joining pipe, a first holder part 141 arranged at the back of the guide pawl 124 for holding the side of the fuel filter 83, an inserting piece 142 forming the end 95*a* of the filter cover and inserted into the battery box 94 and a hinge arm 143 including a second hinge 139*b* as the hinged part 139 for holding the fuel hose 84 are provided.

The first half body 136 is provided with holding holes 118 fitted to the pawls 116 provided to the battery box 94 and fastening holes 119 provided to the inserting piece 142 for attaching the inserting piece to the battery box 94, and holes 145 for aligning when the second half body 138 is fitted to the first half body 136 are bored. A reference numeral 146 denotes a fastening hole.

On the inside surface 136*u* of the first half body 136, a rib 151 for pressing the fuel pressure regulator 85 when the fuel pressure regulator 85 is attached is planted on the back side of the first holder part 141, a holder bolster 152 extended horizontally for supporting the holder 98 from the downside is provided under the rib 151, and a pawl hole 153 into which the pawl 124 provided to the holder 98 is fitted when the holder 98 is attached is provided over the rib 151.

In addition, on the inside surface 136*u*, a pair of opposite pawl bars 131, 131 are provided. That is, the pair of opposite pawl bars 131, 131 are provided to the filter cover 95 and the holder bolster 152 for bearing the holder 98 is provided to lower ends 131*b* of these pawl bars 131, 131.

The second half body 138 is provided with the first hinge 139*a* functioning as a turn, a guide part 155 extended in a substantial U shape in a bottom view from the first hinge 139*a* for fastening the joining pipe together with the guide pawl 124 provided to the first half body 136, a second holder part 156, a convex portion 170 provided to the second holder part 156 for pressing the side of the fuel filter along the periphery 83*s* of the fuel filter 83 and protrusions 158, 158 fitted into holes 145, 145 provided to the first half body 136 when the second half body 138 is fitted to the first half body 136. A reference numeral 159 denotes a fastening hole.

Skirts 161 covering each connection in which each pipe is connected for preventing a foreign matter from adhering to the connection are provided at upper and lower ends of the first holder part 141 and the second holder part 156.

When the fuel pressure regulator 85 is attached to the filter cover 95 beforehand before the filter cover 95 is attached to the body frame, the fuel pressure regulator 85 is pressed by the holder 98 to which the fuel pressure regulator 85 is attached and the rib 151 planted on the filter cover 95. As the rib 151 is provided to the filter cover 95, the fuel pressure regulator 85 is hardly arranged off a predetermined housed position. Therefore, the fuel pressure regulator 85 can be securely held between the filter cover 95 and the holder 98 without increasing the number of parts.

When the holder 98 that holds the fuel pressure regulator 85 is attached to the filter cover 95 beforehand before the filter cover 95 is attached to the body frame 11, the holder 98 can be attached to the filter cover 95 without using a fastening member such as a screw.

As no fastening member is required, the number of parts can be reduced. In addition, attaching work is facilitated.

As the convex portion 134 is provided to the filter cover 95 along the periphery 83*s* of the fuel filter 83, fear that the fuel filter 83 attached to the filter cover 95 is rattled can be removed. As the fuel filter 83 is hardly rattled, the fuel filter 83 can be securely held in the filter cover 95 without increasing the number of parts.

Figure 14:
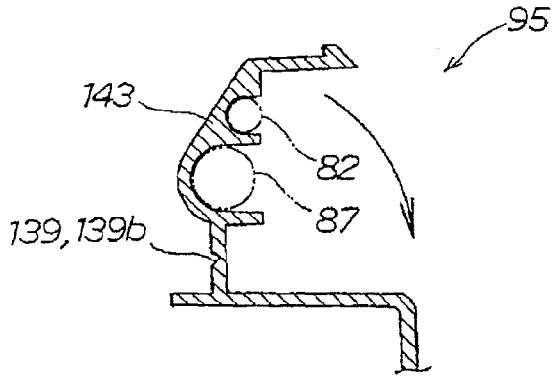
FIG. 14 is a sectional view viewed along a line 14-14 in FIG. 11.

FIG. 14 is a sectional view viewed along a line 14-14 in FIG. 11 and the hinge arm 143 including the second hinge 139*b* as the hinged part 139 holding the supply pipe 82 and the return hose 87 as a fuel pipe is provided to the filter cover 95.

As the hinge arm 143 is provided in an upper part of the filter cover 95, a separate member such as a hose band is not required. Work for holding the fuel hoses is also easy.

The action of structure for attaching the fuel pressure regulator of the above-mentioned vehicle will be described below.

Figure 15A:
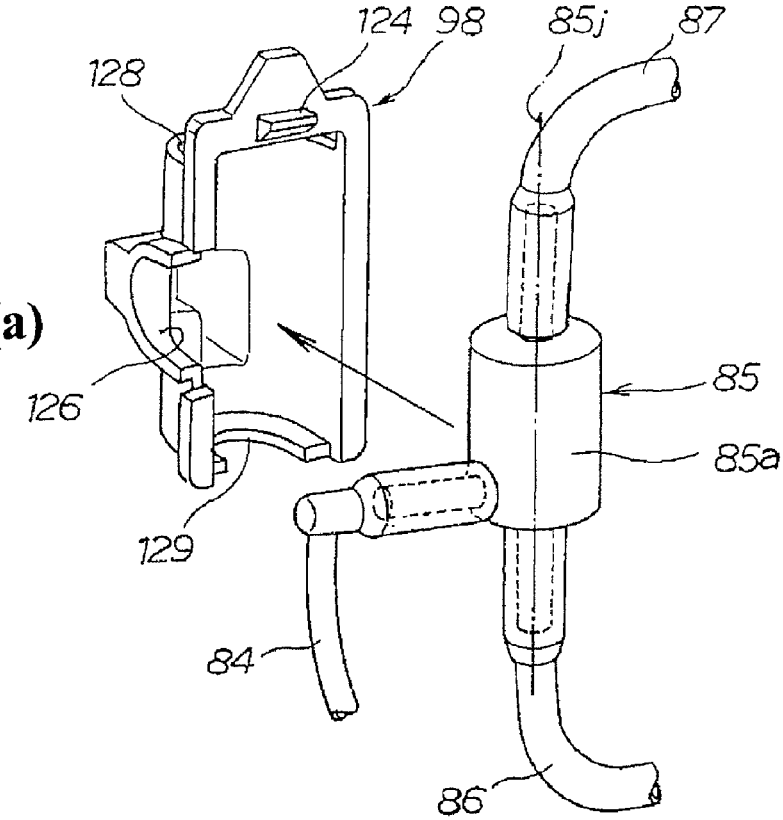
FIGS. 15(*a*) and (*b*) are explanatory drawings for explaining action according to the invention (the attachment of the fuel pressure regulator to the holder)
Figure 15B:
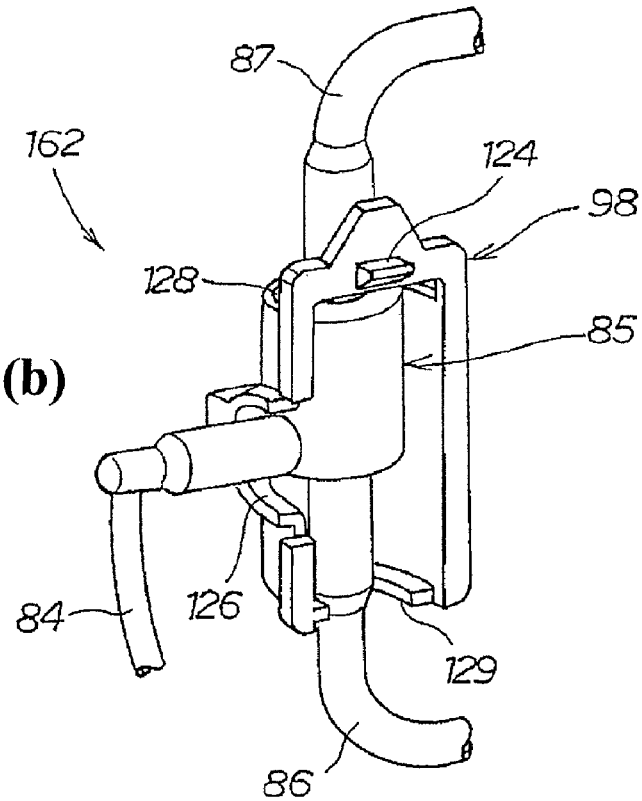

FIGS. 15(*a*) and (*b*) are explanatory drawings for explaining the action according to the invention (the attachment of the fuel pressure regulator to the holder), the cutout 126 is provided to the holder 98, and the first shaft releasing part 128 and the second shaft releasing part 129 are provided for the longitudinal shaft 85*a* provided to the fuel pressure regulator 85.

As shown in FIG. 15(*a*), the fuel pressure regulator is built in the holder 98 in a state in which the return hose 87 and the joining pipe 86 are connected to the upside and the downside of the longitudinal shaft 85*a* forming the fuel pressure regulator 85 and the fuel hose 84 is connected to the side of the longitudinal shaft 85*a*.

As the side of the filter cover of the holder 98 is released when the fuel pressure regulator 85 is set in the holder 98, the first and second shaft releasing parts 128 and 129 which the return hose 87 and the joining pipe 86 respectively connected in a direction of the axis 85*j* of the longitudinal shaft 85*a* pierce are provided and the cutout 126 which the fuel hose 84 connected to the side pierces is provided, the fuel pressure regulator 85 can be easily set in the holder 98.

FIG. 15(*b*) shows a state in which the fuel pressure regulator 85 to which the fuel pipes 162 are connected is built in the holder 98. The fuel pipes 162 denote a pipe in which fuel flows such as the supply pipe (the reference numeral 82 in FIG. 4), the fuel hose 84, the joining pipe 86 and the return hose 87.

Figure 16A:
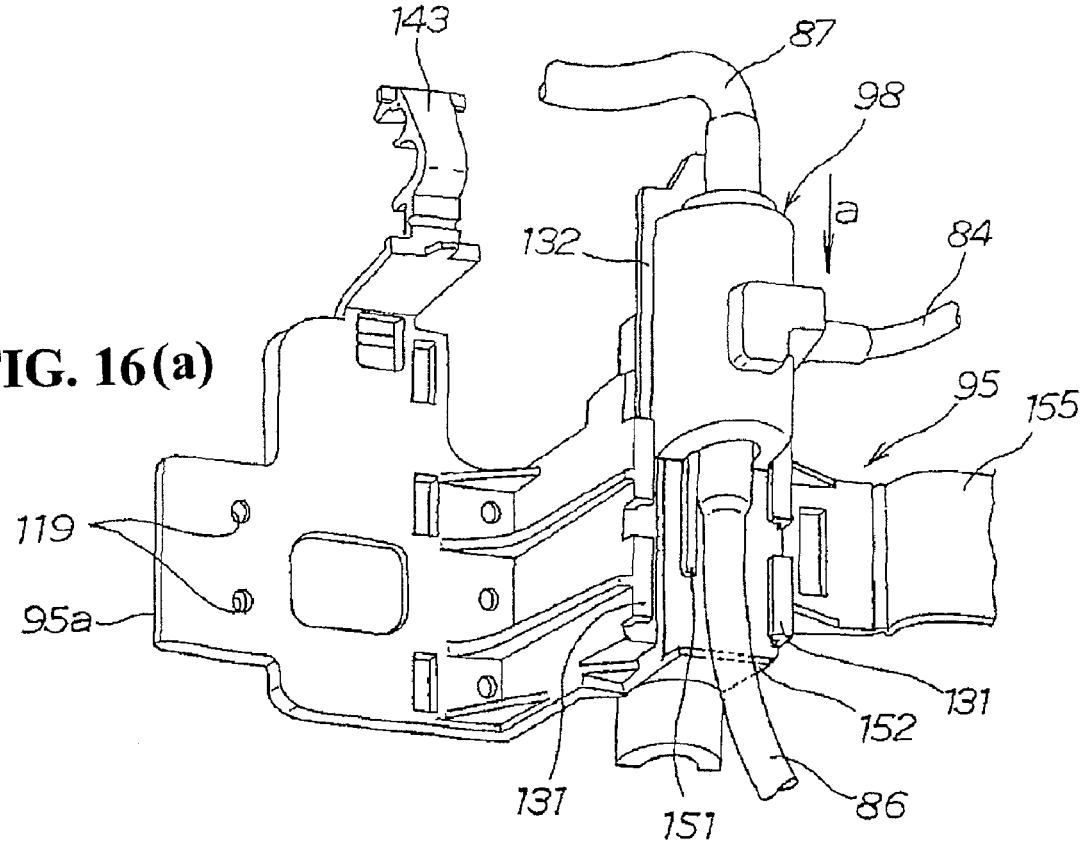
FIGS. 16(*a*) and (*b*) are explanatory drawings for explaining action according to the invention (the attachment of the holder to the filter cover)
Figure 16B:
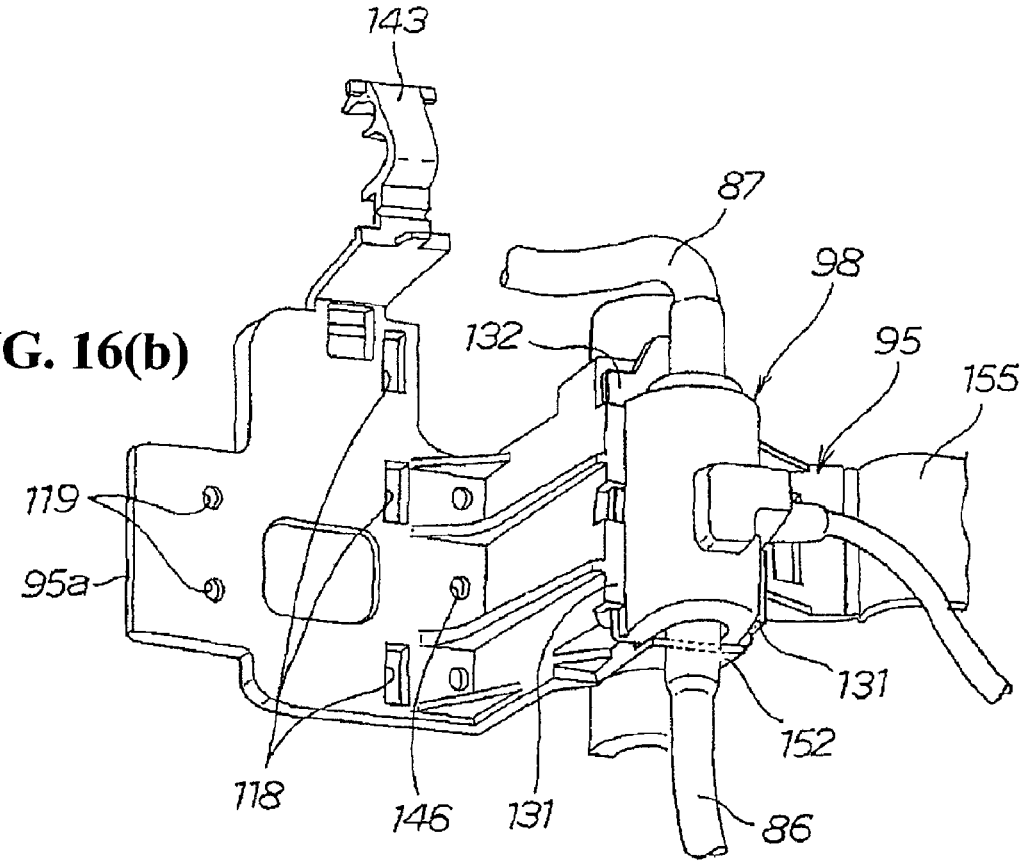

FIGS. 16(*a*) and (*b*) are explanatory drawings for explaining action according to the invention (the attachment of the holder to the filter cover).

As shown in FIG. 16(*a*), the holder 98 is attached to the filter cover 95 by fitting the sliding parts 132, 132 provided to the holder 98 to the pawl bars 131, 131 provided to the filter cover 95 from a direction shown by an arrow a, fitting the pawl (the reference numeral 124 in FIG. 9) of the holder and the pawl hole (the reference numeral 153 in FIG. 12) of the filter cover and sliding the sliding parts to a location in which the holder bolster 152 and the holder 98 are touched.

FIG. 16(*b*) shows a state in which the holder 98 in which the fuel pressure regulator 85 is built is attached to the filter cover 95.

The rib 151 for pressing the fuel pressure regulator 85 is planted on the filter cover 95 along the side of the fuel pressure regulator 85 so that the rib is opposite to the first and second shaft releasing parts 128, 129.

As the rib 151 is provided to the filter cover 95, the fuel pressure regulator 85 is hardly arranged off a predetermined housed position. Therefore, the fuel pressure regulator can be securely held between the filter cover 95 and the holder 98 without increasing the number of parts.

Figure 17A:
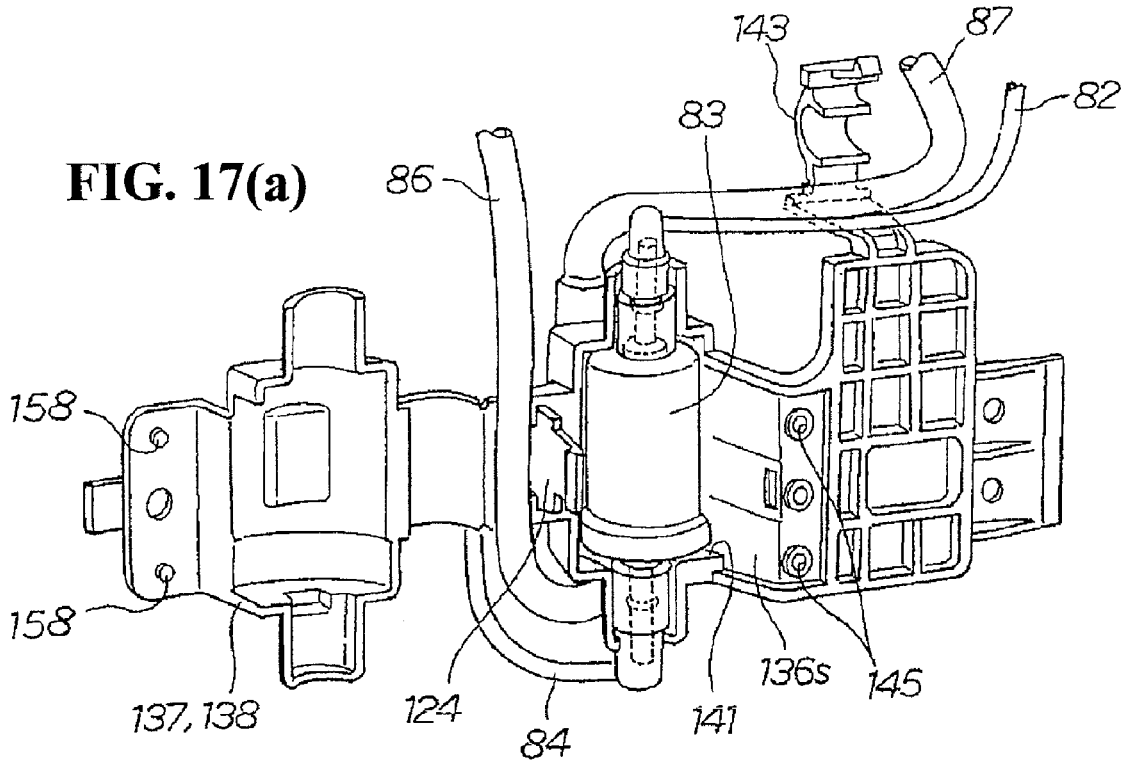
FIGS. 17(*a*) and (*b*) are explanatory drawings for explaining action according to the invention (fixing the fuel filter with a covering part provided to the filter cover)
Figure 17B:
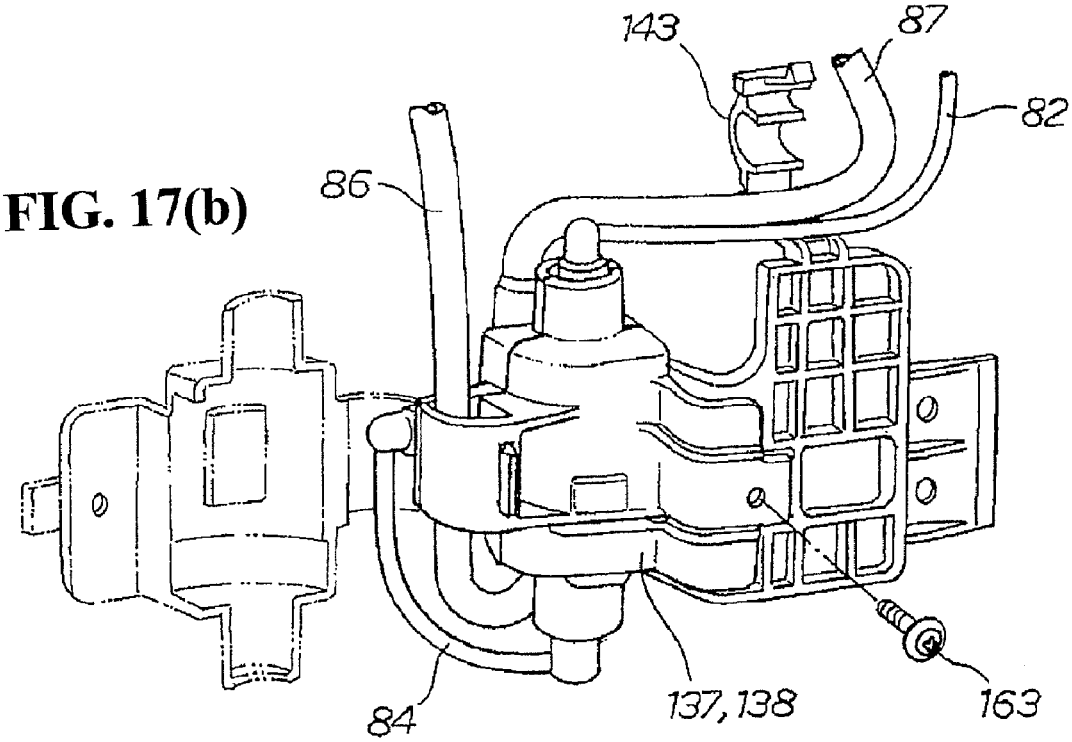

FIGS. 17(*a*) and (*b*) are explanatory drawings for explaining action according to the invention (fixing the fuel filter with the covering part provided to the filter cover) and also referring to FIG. 11, explanation will be made below.

As shown in FIG. 17(*a*), the second half body 138 is turned inside in a state in which the first holder part 141 provided to the outside surface 136*s* of the first half body 136 forming the filter cover 95 is fitted to the outside surface of the fuel filter 83 and the joining pipe 86 is arranged along the guide pawl 124, and the protrusions 158, 158 are fitted into the holes 145, 145.

As shown in FIG. 17(*b*), the second half body 138 is attached to the first half body 136 by a screw 163. About the same time as the work, the other end of the fuel hose 84 connected to the fuel pressure regulator 85 is connected to an outlet of the fuel filter 83 and the supply pipe 82 is connected to an inlet of the fuel filter 83. In this case, as the holder 98 is fitted and supported to/by the filter cover 95 via the sliding part and the joining pipe 86 is guided by the guide part (the reference numeral 155 in FIG. 13) of the filter cover though the rigidity of the joining pipe is high because the joining pipe 86 is a rubber pipe for high-pressure fuel, the joining pipe can be attached in small space with it vertically bent by approximately 180°.

Figure 18:
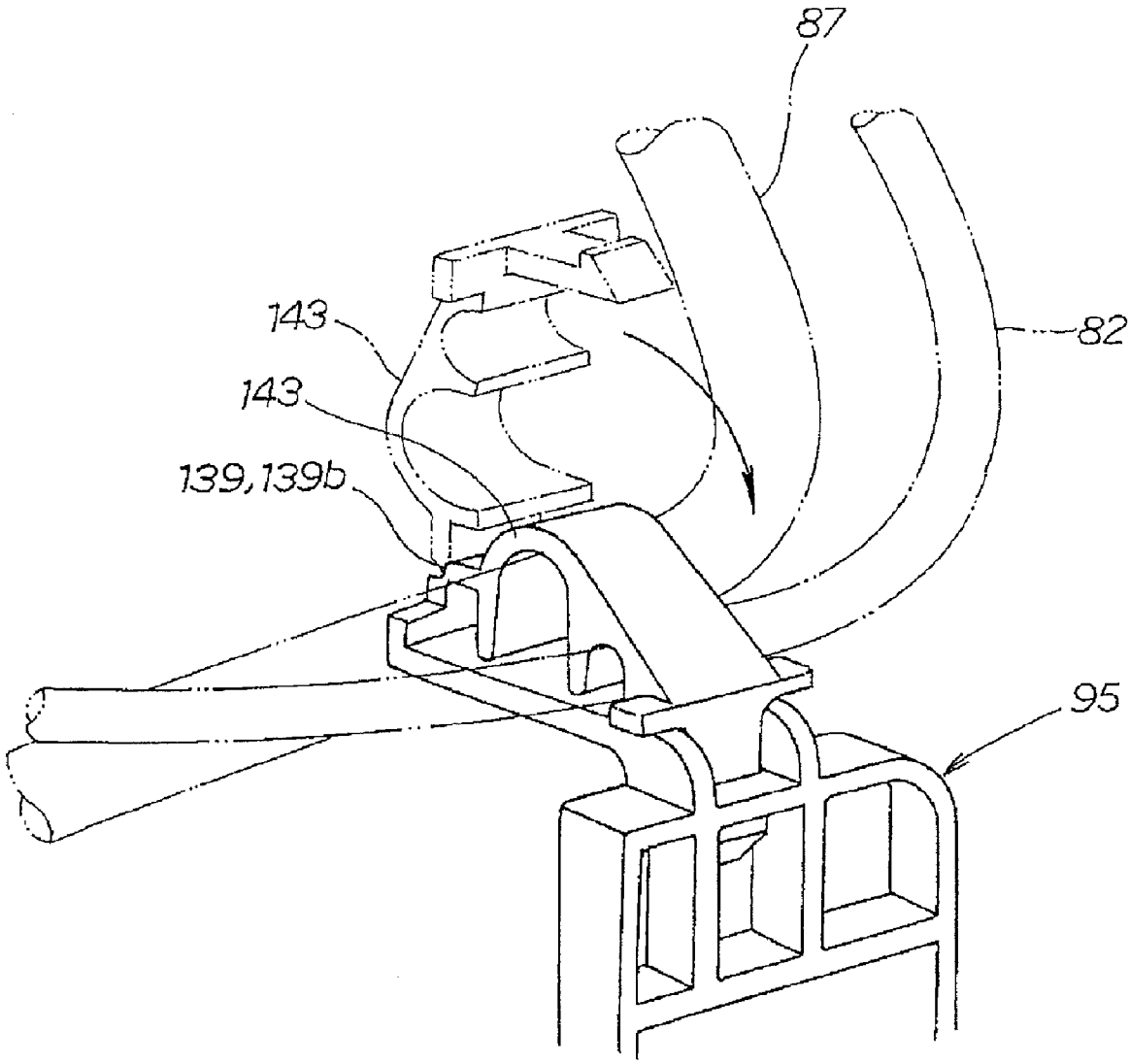
FIG. 18 is an explanatory drawing for explaining action according to the invention (fixing a fuel hose with a hinge arm)

FIG. 18 is an explanatory drawing for explaining action according to the invention (fixing the fuel hose with the hinge arm).

As the hinge arm 143 including the hinged part 139 for holding the fuel hose 84 is provided to the filter cover 95, a guide for piping fuel is not required to be separately provided. As the guide for the fuel hose 84 is not required to be separately provided, the fuel pipes can be securely fastened, reducing the number of parts.

FIGS. 19(*a*) and (*b*) are explanatory drawings for explaining action according to the invention (the attachment of the filter cover to the battery box).

As shown in FIG. 19(*a*), the inserting piece 142 provided to the filter cover 95 is moved in a direction shown by an arrow a2, is inserted into the rectangular hole (the reference numeral 115 in FIG. 5) provided to the battery box 94, and the holding holes 118 provided to the filter cover 95 are fitted to the pawls 116 provided to the battery box 94.

As shown in FIG. 19(*b*), the screw 96 is inserted into the fastening hole 119 and fastens the filter cover 95. About the same time as this work, the other end of the supply pipe 82 is connected to an outlet of the fuel pump, the other end of the return hose 87 is connected to a return orifice of the fuel tank 33, and the other end of the joining pipe 86 is connected to the fuel injection system 50.

An assembly flow based upon FIGS. 15(*a*) to 19(*b*) will be described below.

Figure 20:
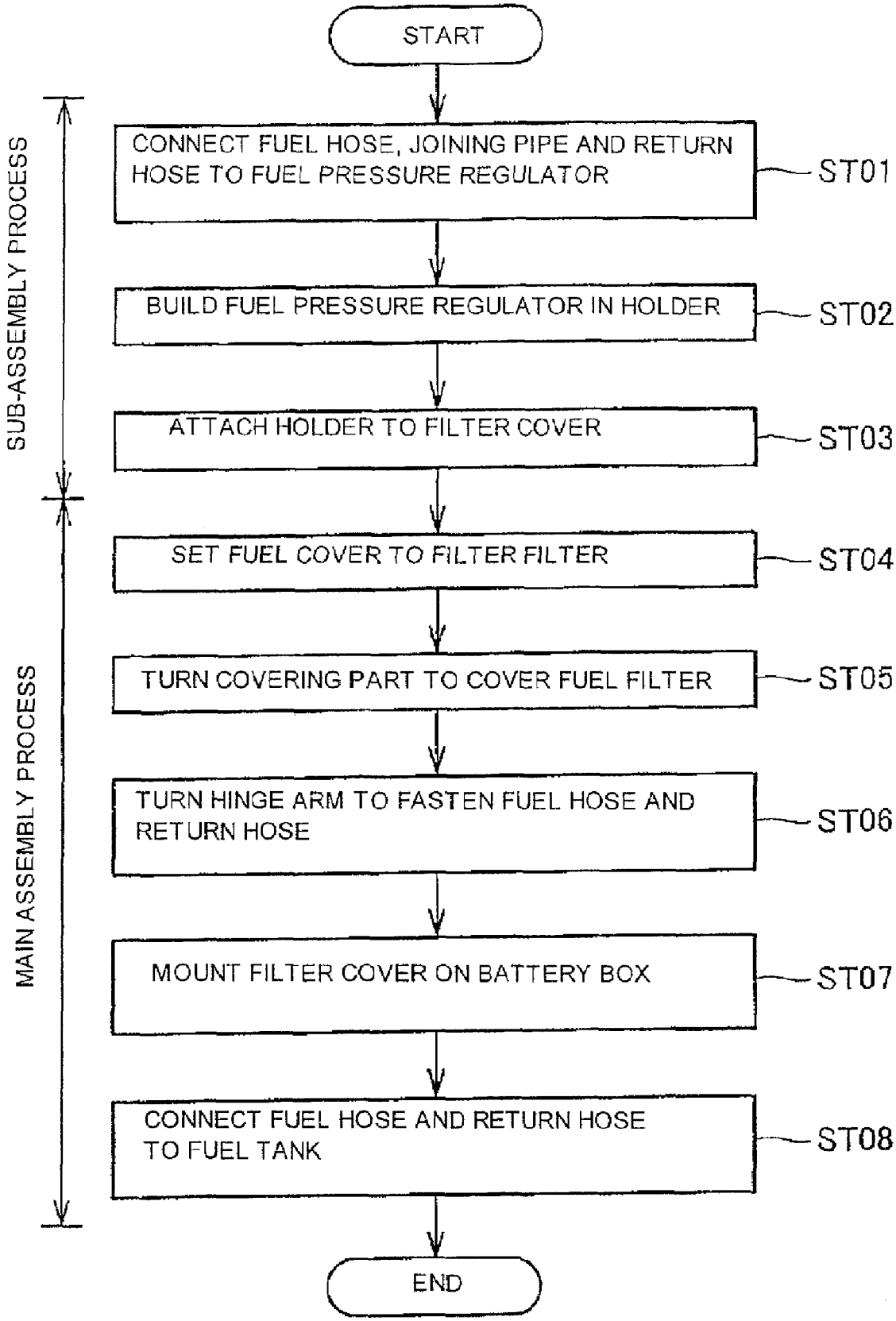
FIG. 20 is a flowchart for explaining order in assembling fuel supply equipment according to the invention.

FIG. 20 is a flowchart for explaining order in which the fuel supply equipment according to the invention is assembled and explains a method of assembling the fuel supply equipment 80.

In a step number (hereinafter called ST) 01, the fuel hose 84, the joining pipe 86 and the return hose 87 are connected to the fuel pressure regulator 85, in ST02, the fuel pressure regulator 85 to which the return hose 87 is connected is attached to the holder 98, and in ST03, the holder 98 to which the fuel pressure regulator is connected is attached to the filter cover 95.

In ST04, the filter cover 95 which is built in ST03 beforehand and in which the fuel pressure regulator 85 and the holder 98 are integrated is attached to the fuel filter 83 provided on the side of the body, in ST05, the covering part 137 is turned inside to cover the fuel filter 83, the joining pipe 86 is guided, and the covering part 137 is fixed by the screw 163.

At this time, the joining pipe 86 is held by the guide part 155 formed in a part of the covering part 137.

In ST06, the filter cover 95 integrated with the fuel filter 83 is attached to the battery box 94, in ST07, the hinge arm 143 is bent, and the fuel hose 84 and the return hose 87 are fastened to the filter cover 95.

As the joining pipe 86 is fastened to the filter cover 95 owing to the guide part 155 and the fuel hose 84 and the return hose 87 are fastened to the filter cover by the hinge arm 143, the pipe and the hoses can be fastened by simple work without separately using a banding member.

In ST08, the fuel hose 84 and the return hose 87 are connected to the fuel tank 33 and a series of work related to the assembly of the fuel supply equipment 80 is completed.

When a vehicular assembling process includes a sub-assembly process in which small parts are sub-assembled and a main assembly process in which the sub-assembled small parts are attached to a skeleton of the vehicle, the fuel pressure regulator 85 can be built at the same time as the filter cover 95 is built in the fuel filter 83 in the main assembly process when the fuel filter 83 is provided on the side of the body frame 11 if only the fuel pressure regulator 85 is built in the holder 98 and the holder 98 is built in the filter cover 95 in the sub-assembly process beforehand in ST01 to ST03.

As described above, as the fuel pressure regulator 85 is attached to the filter cover 95 via the holder 98 in the sub-assembly process beforehand, assembling work can be facilitated in the main assembly process when the vehicle 10 is assembled and a load related to the work can be reduced. If the load related to the work is reduced, work time related to the assembly of the fuel supply equipment 80 can be reduced. If the assembly work time of the fuel supply equipment 80 can be reduced in the main assembly process, time related to the assembly of the fuel supply equipment 80 can be easily inhibited within the tact time of an assembly line. If the time related to the assembly of the fuel supply equipment 80 is easily inhibited within the tact time, lines can be flexibly organized, can be easily balanced, and productivity in the main assembly process can be enhanced. In addition, the possibility of wrong assembly such as a pipe is attached by mistake in the main assembly process can be reduced.

Workability when the fuel filter is maintained after the vehicle is completed will be described below.

As shown in FIGS. 3 and 4, the filter cover 95 that covers the fuel filter 83 is provided around the fuel filter 83 and the fuel pressure regulator 85 is arranged so that it is located inside the filter cover 95 and is overlapped with the filter cover 95 in a side view.

A workman can easily recognize the fuel filter 83 to be maintained by almost hiding the fuel pressure regulator 85 from the side with the filter cover 95.

In addition, as the fuel pressure regulator 85 is arranged so that it is located inside the filter cover 95 and is overlapped with the filter cover 95 when the vehicle 10 is viewed from the side, the plural pipes and hoses at least including the fuel hose 84 connected to the fuel pressure regulator 85 and the fuel filter 83 can be easily discriminated. As the plural pipes and hoses mutually arranged close are easily discriminated, wrong work in the connection of the pipes and hoses can be avoided.

As the fuel filter 83 can be easily recognized and in addition, the pipe and the hose connected to the fuel filter 83 can be easily discriminated, the maintainability of the fuel filter 83 can be enhanced.

As also shown in FIGS. 17(*a*) and (*b*) and 19(*a*) and (*b*), as the covering part 137 including the hinged part 139 for holding the fuel filter 83 is provided to the filter cover 95, the covering part 137 can be opened/closed by only removing the screw 163 in a state which the filter cover 95 is attached on the side of the vehicle. As only the covering part 137 is configured to be openable, the fuel filter 83 can be more easily maintained.

As the connectors 165 are connected to both ends of the fuel filter 83 and these connectors 165 are covered with the skirts 161 provided to the upper and lower ends of the filter cover 95, dust and others hardly adhere to a connection with each connector 165. Dust and others hardly adhere to the connection with each connector 165 and the connection with each connector 165 can be easily kept clean.

If the connection with each connector 165 can be easily kept clean, the contamination of the connection is not required to be cared so much and the maintenance such as a check and replacement of the fuel filter 83 can be more easily performed.

The fuel supply equipment of the present invention is applied to the motorcycle in the embodiment, however, the invention can be also applied to a saddle-ride type vehicle, and may be also applied to a general vehicle.

In addition, the rib provided to the filter cover for pressing the fuel pressure regulator may be also omitted.

Further, the structure for attaching the holder to the filter cover may be arbitrary structure if only the fuel pressure regulator is held in the holder.

Still further, the hinge arm provided to the filter cover may be also omitted.

The invention being thus described, it will be obvious that the same may be varied in many other ways. Such variations are not to be regarded as a departure from the spirit and scope of the invention, and all such modifications as would be obvious to one skilled in the art are intended to be included within the scope of the following claims.

What is claimed is:

1. Vehicular fuel supply equipment comprising:

a fuel tank for storing fuel for an internal combustion engine;

a fuel pump for feeding the fuel in the fuel tank to a fuel injection system provided to the internal combustion engine;

a fuel filter connected to an outflow side of the fuel pump, said fuel filter being provided outside the fuel tank for filtering the fuel;

a fuel hose connected to an outflow side of the fuel filter;

a fuel pressure regulator connected to the fuel hose keeping the fuel supplied to the fuel injection system under a predetermined pressure;

a joining pipe connected between the fuel pressure regulator and the fuel injection system; and a return hose connected between the fuel pressure regulator and the fuel tank for returning extra fuel to the fuel tank, wherein a fuel filter cover for covering the fuel filter is provided around the fuel filter; and the fuel pressure regulator is arranged so that it is located inside the fuel filter cover and is overlapped with the fuel filter cover when the vehicle is viewed in a side view, wherein the fuel filter cover encircles the fuel filter; and further comprising a holder attached to the fuel filter cover, the holder being adapted to support the fuel pressure regulator is disposed on the fuel filter cover along a lateral side of the fuel pressure regulator.

2. The vehicular fuel supply equipment according to claim 1, wherein a covering part that includes a hinged part and holds the fuel filter is provided to the fuel filter cover.

3. The vehicular fuel supply equipment according to claim 1, wherein a connector is connected to both ends of the fuel filter; and each connector is covered with the fuel filter cover.

4. The vehicular fuel supply equipment according to claim 2, wherein a connector is connected to both ends of the fuel filter; and each connector is covered with the fuel filter cover.

5. The vehicular fuel supply equipment according to, claim 1, comprising:

a pair of opposite pawl bars formed on the fuel filter cover;

a holder bolster formed at lower ends of the pawl bars, the holder bolster being adapted to receive the holder; and a sliding part provided to the holder, wherein the holder is attached to the fuel filter cover by sliding the sliding part onto the pawl bars.

6. The vehicular fuel supply equipment according to claim 1, wherein a convex portion is provided to the fuel filter cover along a periphery of the fuel filter.

7. The vehicular fuel supply equipment according to claim 1, wherein the fuel filter cover holds the fuel filter and is attached to a front of a battery box which is attached to a body frame via screws, and the fuel pressure regulator is attached to the fuel filter cover via the holder.

8. Vehicular fuel supply equipment, comprising:

a fuel tank for storing fuel for an internal combustion engine;

a fuel pump for feeding the fuel in the fuel tank to a fuel injection system provided to the internal combustion engine;

a fuel filter connected to an outflow side of the fuel pump, said fuel filter being provided outside the fuel tank for filtering the fuel;

a fuel hose connected to an outflow side of the fuel filter;

a fuel pressure regulator connected to the fuel hose keeping the fuel supplied to the fuel injection system under a predetermined pressure;

a joining pipe connected between the fuel pressure regulator and the fuel injection system; and a return hose connected between the fuel pressure regulator and the fuel tank for returning extra fuel to the fuel tank, wherein a fuel filter cover for covering the fuel filter is provided around the fuel filter; and the fuel pressure regulator is arranged so that it is located inside the fuel filter cover and is overlapped with the fuel filter cover when the vehicle is viewed in a side view, and further comprising:

a holder attached to the fuel filter cover, the holder being adapted to support the fuel pressure regulator, wherein a direction of a longitudinal shaft of the fuel pressure regulator is arranged in a vertical direction of the vehicle;

the fuel hose is connected to a side of the longitudinal shaft;

the joining pipe and the return hose are connected in an axial direction of the longitudinal shaft;

an opening wider than an outside diameter of the fuel pressure regulator is formed on a filter cover side of the holder, the opening being formed in the direction of the longitudinal shaft of the fuel pressure regulator;

a cutout communicating with the opening on the side of the holder is provided to the holder, the cutout being wider than an outside diameter of the fuel hose; and a first shaft releasing part wider than an outside diameter of the return hose and a second shaft releasing part wider than an outside diameter of the joining pipe are provided on an axis of the longitudinal shaft in a state in which the fuel pressure regulator is held in the holder.

9. The vehicular fuel supply equipment according to claim 8, wherein the fuel filter cover encircles the fuel filter.

10. The vehicular fuel supply equipment according to claim 8, wherein a rib for pressing the fuel pressure regulator is disposed on the fuel filter cover along a side of the fuel pressure regulator opposite to the first and second shaft releasing parts.

11. The vehicular fuel supply equipment according to claim 8, wherein a hinge arm including a hinged part adapted to hold the fuel hose is provided to the fuel filter cover.

12. Fuel supply equipment for a vehicle, comprising:

a body frame;

a fuel tank mounted on the body frame for storing fuel for an internal combustion engine;

a fuel pump for feeding the fuel in the fuel tank to a fuel injection system provided to the internal combustion engine;

a fuel filter connected to an outflow side of the fuel pump, said fuel filter being provided outside the fuel tank and for filtering the fuel;

a fuel hose connected to an outflow side of the fuel filter;

a fuel pressure regulator connected to the fuel hose for keeping the fuel supplied to the fuel injection system under predetermined pressure;

a joining pipe connected between the fuel pressure regulator and the fuel injection system; and a return hose connected between the fuel pressure regulator and the fuel tank for returning extra fuel to the fuel tank, wherein a fuel filter cover for covering the fuel filter is provided around the fuel filter; and the fuel pressure regulator is arranged so that it is located inside the fuel filter cover and is overlapped with the fuel filter cover when the body frame is viewed in a side view, wherein the fuel filter cover encircles the fuel filter; and further comprising a holder attached to the fuel filter cover, the holder being adapted to support the fuel pressure regulator, wherein a direction of a longitudinal shaft of the fuel pressure regulator is arranged in a vertical direction of the vehicle;

the fuel hose is connected to a side of the longitudinal shaft;

the joining pipe and the return hose are connected in an axial direction of the longitudinal shaft;

an opening wider than an outside diameter of the fuel pressure regulator is formed on a filter cover side of the holder, the opening being formed in the direction of the longitudinal shaft of the fuel pressure regulator;

a cutout communicating with the opening on the side of the holder is provided to the holder, the cutout being wider than an outside diameter of the fuel hose; and a first shaft releasing part wider than an outside diameter of the return hose and a second shaft releasing part wider than an outside diameter of the joining pipe are provided on an axis of the longitudinal shaft in a state in which the fuel pressure regulator is held in the holder.

13. The fuel supply equipment according to claim 12, wherein a covering part that includes a hinged part and holds the fuel filter is provided to the fuel filter cover.

14. The fuel supply equipment according to claim 12, wherein a connector is connected to both ends of the fuel filter; and each connector is covered with the fuel filter cover.

15. The fuel supply equipment according to claim 13, wherein a connector is connected to both ends of the fuel filter; and each connector is covered with the fuel filter cover.

16. The fuel supply equipment according to claim 12, wherein a rib for pressing the fuel pressure regulator is disposed on the fuel filter cover along a side of the fuel pressure regulator opposite to the first and second shaft releasing parts.

17. The fuel supply equipment according to claim 7, comprising:

a pair of opposite pawl bars formed on the fuel filter cover;

a holder bolster formed at lower ends of the pawl bars, the holder bolster being adapted to receive the holder; and a sliding part provided to the holder, wherein the holder is attached to the fuel filter cover by sliding the sliding part onto the pawl bars.

18. The fuel supply equipment according to claim 15, wherein a hinge arm including a hinged part adapted to hold the fuel hose is provided to the fuel filter cover.

19. The fuel supply equipment according to claim 7, wherein a convex portion is provided to the fuel filter cover along a periphery of the fuel filter.

* * * * *